US010607536B2

(12) United States Patent
Miyasaka et al.

(10) Patent No.: US 10,607,536 B2
(45) Date of Patent: Mar. 31, 2020

(54) ELECTRO-OPTICAL DEVICE AND ELECTRONIC APPARATUS CAPABLE OF DISPLAYING A HIGH-RESOLUTION, MULTI-GRAY-SCALE, AND HIGH QUALITY IMAGE AT LOW POWER CONSUMPTION

(71) Applicant: SEIKO EPSON CORPORATION, Tokyo (JP)

(72) Inventors: Mitsutoshi Miyasaka, Suwa (JP); Yoichi Momose, Matsumoto (JP); Kiyoshi Sekijima, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/224,362

(22) Filed: Dec. 18, 2018

(65) Prior Publication Data

US 2019/0189051 A1 Jun. 20, 2019

(30) Foreign Application Priority Data

Dec. 19, 2017 (JP) ..... 2017-242457

(51) Int. Cl.

| | |
|---|---|
| ***G09G 3/30*** | (2006.01) |
| ***G09G 3/3225*** | (2016.01) |
| ***G09G 3/3266*** | (2016.01) |
| ***G09G 3/3275*** | (2016.01) |

(52) U.S. Cl.

CPC ..... *G09G 3/3225* (2013.01); *G09G 3/3266* (2013.01); *G09G 3/3275* (2013.01); *G09G 2300/0842* (2013.01); *G09G 2320/0233* (2013.01); *G09G 2330/021* (2013.01)

(58) Field of Classification Search

CPC ..... G09G 2300/0842; G09G 3/3233; G09G 3/3258

USPC ..... 345/76–80

See application file for complete search history.

(56) References Cited

U.S. PATENT DOCUMENTS

| | | | | |
|---|---|---|---|---|
| 2002/0018029 | A1* | 2/2002 | Koyama | G09G 3/3275 345/39 |
| 2002/0070913 | A1 | 6/2002 | Kimura et al. | |
| 2003/0142054 | A1* | 7/2003 | Tada | G09G 3/3614 345/87 |

(Continued)

FOREIGN PATENT DOCUMENTS

| | | | |
|---|---|---|---|
| JP | 2004-62199 | A | 2/2004 |
| JP | 2004-163601 | A | 6/2004 |
| JP | 2007-206681 | A | 8/2007 |

*Primary Examiner* — Roy P Rabindranath

(74) *Attorney, Agent, or Firm* — Oliff PLC

(57) ABSTRACT

An electro-optical device includes a pixel circuit located at a position corresponding to an intersection of a scan line and a data line, a low potential line, and a high potential line. The pixel circuit includes a light emitting element, a first transistor, a memory circuit including a first inverter, a second inverter, and a second transistor, and a third transistor. The first transistor is disposed between an input of the first inverter and the data line. The second transistor is disposed between an output of the second inverter and the input. The third transistor and the light emitting element are disposed between the low potential line and the memory circuit. When the first transistor is in an ON-state, the second transistor and the third transistor are in an OFF-state.

6 Claims, 11 Drawing Sheets

(56) References Cited

U.S. PATENT DOCUMENTS

2006/0221033 A1* 10/2006 Yasuda ..... G09G 3/3648
345/92
2007/0159417 A1 7/2007 Miyake

* cited by examiner

ELECTRO-OPTICAL DEVICE AND ELECTRONIC APPARATUS CAPABLE OF DISPLAYING A HIGH-RESOLUTION, MULTI-GRAY-SCALE, AND HIGH QUALITY IMAGE AT LOW POWER CONSUMPTION

BACKGROUND

1. Technical Field

The invention relates to an electro-optical device and an electronic apparatus.

2. Related Art

In recent years, head-mounted displays (HMDs) have been proposed that are a type of electronic apparatus that enables formation and viewing of a virtual image by directing image light from an electro-optical device to the pupil of an observer. One example of the electro-optic device used in these electronic devices is an organic electro-luminescence (EL) device that includes an organic EL element as a light-emitting element. The organic EL devices used in head-mounted displays are required to provide high resolution, fine pixels, multiple gray-scales of display, and low power consumption.

In known organic EL devices, when a selecting transistor is placed into an ON-state by a scan signal supplied to a scan line, an electrical potential based on an image signal supplied from a data line is maintained in a capacitive element connected to the gate of a driving transistor. When the driving transistor is placed into the ON-state according to the potential maintained in the capacitive element, namely, the gate potential of the driving transistor, a current in amount according to the gate potential of the driving transistor flows to the organic EL element, and the organic EL element emits light at an intensity according to the current amount.

In this way, the gray-scale display is performed by analog driving that controls the current flowing through the organic EL element according to the gate potential of the driving transistor in a typical organic EL device. Thus, variations in current-voltage characteristics and a threshold voltage of the driving transistor cause variations in brightness and shifts in gray-scale between pixels. As a result, display quality may decrease. In contrast, an organic EL device including a compensating circuit that compensates for variations in current-voltage characteristics and a threshold voltage of a driving transistor has been conceivable (for example, see JP-A-2004-062199).

However, when a compensating circuit is provided as described in JP-A-2004-062199, a current also flows through the compensating circuit, which may cause an increase in power consumption. For typical analog driving, the electric capacitance of a capacitive element that stores an image signal needs to be increased in order to achieve more gray-scales of display. This requirement is a trade-off with high resolution and fine pixels, and may result in an increased power consumption due to charging and discharging of the capacitive element. In other words, in the typical technology, an electro-optical device capable of displaying a high-resolution, multi-gray-scale, and high-quality image at low power consumption may be difficult to achieve.

SUMMARY

The invention is made to address at least some of the above-described issues, and can be realized as the following aspects or application examples.

Application Example 1

An electro-optical device according to the present application example includes a scan line, a data line, a pixel circuit located at a position corresponding to an intersection of the scan line and the data line, a first potential line supplying a first potential, and a second potential line supplying a second potential that differs from the first potential. The pixel circuit includes a light emitting element, a first transistor, a memory circuit that includes a first inverter, a second inverter and a second transistor light emitting element, and a third transistor. The memory circuit is disposed between the first potential line and the second potential line. The first transistor is disposed between an input of the first inverter and the data line. The second transistor is disposed between an output of the second inverter and the input of the first inverter. An output of the first inverter is electrically connected to an input of the second inverter. The third transistor and the light emitting element are disposed between the first potential line and the memory circuit. When the first transistor is in an ON-state, the second transistor and the third transistor are in an OFF-state.

According to the configuration of the present application example, the memory circuit including the first inverter and the second inverter is disposed between the first potential line and the second potential line, and the first transistor is disposed between the input of the first inverter and the data line in the pixel circuit. Thus, gray-scale display can be performed by writing a digital image signal expressed by binary values of ON and OFF from the data line to the memory circuit through the first transistor and controlling the ratio of emission to non-emission of the light emitting element with the image signal output from the memory circuit. In this way, the influence of variation in the current-voltage characteristics and the threshold voltage of each transistor can be minimized and the variation in brightness and shifts in gray-scale between pixels can be reduced without a compensating circuit.

When the image signal is written or rewritten to the first inverter and the second inverter with the first transistor in the ON-state, the second transistor in the OFF-state interrupts the electrical connection between the output of the second inverter and the input of the first inverter in the memory circuit, such that the image signal can be written or rewritten to the memory circuit in a quick and reliable manner. Furthermore, the image signal is written from the data line to the first inverter and then from the first inverter to the second inverter. This can eliminate a complementary data line and a complementary transistor as compared to a case where a complementary image signal is written from a complementary data line to a second inverter simultaneously with writing of an image signal from a data line to a first inverter. Accordingly, pixels can be made finer and thus, a higher resolution can be easily achieved, and manufacturing yield can be improved without a need to increase the number of wires.

Furthermore, when the image signal is written or rewritten with the first transistor in the ON-state, the third transistor in the OFF-state interrupts the path leading from the first potential line through the third transistor, the light emitting element and a transistor constituting the memory circuit, to the second potential line. Thus, the third transistor is in the OFF-state even with the image signal for placing the transistor constituting the memory circuit into the ON-state, and unnecessary current can be prevented from flowing through the memory circuit. Accordingly, the image signal can be written or rewritten to the memory circuit at low power consumption. In addition, the light emitting element does not emit light while an image signal is being written, such that an accurate gray-scale display can be achieved. As a result, the electro-optical device capable of displaying a high-resolution and high-quality image at low power consumption can be achieved at a low cost.

Application Example 2

In the electro-optical device according to the present application example, the first transistor and the second transistor may operate in a complementary manner to each other, and the first transistor and the third transistor may operate in a complementary manner to each other.

According to the configuration of the present application example, the second transistor is in the OFF-state when the first transistor is in the ON-state, and the second transistor is in the ON-state when the first transistor is in the OFF-state. Therefore, with the first transistor in the ON-state and the second transistor in the OFF-state, the image signal can be written or rewritten to the memory circuit in a quick and reliable manner. Then, the image signal written to the memory circuit can be maintained reliably by performing a static storage operation between the first inverter and the second inverter with the second transistor in the ON-state and the first transistor in the OFF-state.

The third transistor is in the OFF-state when the first transistor is in the ON-state, and the third transistor is in the ON-state when the first transistor is in the OFF-state. Therefore, with the first transistor in the ON-state and the third transistor in the OFF-state, the image signal can be written or rewritten to the memory circuit at low power consumption. Then, with the third transistor in the ON-state and the first transistor in the OFF-state, electrical communication is established through the path leading from the first potential line through the third transistor, the light emitting element and the memory circuit, to the second potential line to cause emission or non-emission of the light emitting element based on the image signal stored in the memory circuit.

Application Example 3

In the electro-optical device according to the present application example, the first transistor may be a first conductive type, and the second transistor and the third transistor may be a second conductive type different from the first conductive type, and a gate of the first transistor, a gate of the second transistor, and a gate of the third transistor may be electrically connected to the scan line.

According to the configuration of the present application example, when the first transistor is the N-type, the second transistor and the third transistor are the P-type. Thus, the first transistor is placed into the ON-state and the second transistor and the third transistor are placed into the OFF-state when a High signal is supplied from the scan line. Then, when a Low signal is supplied from the scan line, the first transistor is placed into the OFF-state and the second transistor and the third transistor are placed into the ON-state. On the other hand, when the first transistor is the P-type, the second transistor and the third transistor are the N-type. Thus, the first transistor is placed into the ON-state and the second transistor and the third transistor are placed into the OFF-state when a Low signal is supplied from the scan line. Then, when a High signal is supplied from the scan line, the first transistor is placed into the OFF-state and the second transistor and the third transistor are placed into the ON-state. Therefore, the first transistor and the second transistor can operate in a complementary manner to each other, and the first transistor and the third transistor can operate in a complementary manner to each other by supplying the same scan signal from the scan line.

Application Example 4

In the electro-optical device according to the present application example, a drain of the third transistor may be electrically connected to the light emitting element.

According to the present application example, the third transistor and the light emitting element are disposed between the first potential line and the memory circuit, such that the drain of the third transistor is electrically connected to the light emitting element. Specifically, the third transistor is disposed on the second potential line side with respect to the light emitting element, and a source potential of the third transistor can be a second potential or can be substantially equal to the second potential. Thus, an absolute value of the gate-source voltage with the third transistor in the ON-state can be increased to allow substantially linear operation of the third transistor in the ON-state. Hereinafter, substantially linear operation of a transistor is simply expressed as linear operation. Accordingly, the ON-resistance of the third transistor in the ON-state can be reduced, such that any variation in the threshold voltage of the third transistor can be prevented from affecting light emission intensity of the light emitting element.

Application Example 5

In the electro-optical device according to the present application example, the second inverter may include a fourth transistor, and a source of the fourth transistor may be electrically connected to the second potential line, and a drain of the fourth transistor may be electrically connected to the light emitting element.

According to the configuration of the present application example, the third transistor and the light emitting element are disposed between one of the first potential line and the second potential line and the fourth transistor having a source electrically connected to the second potential line. Thus, the light emitting element emits light when the third transistor and the fourth transistor are in the ON-state. Therefore, the fourth transistor constituting the second inverter in the memory circuit can also function as a driving transistor of the light emitting element. The source of the fourth transistor is electrically connected to the other of the first potential line and the second potential line to allow linear operation of the fourth transistor in the ON-state. Accordingly, the ON-resistance of the fourth transistor in the ON-state can be reduced, such that any variation in the threshold voltage of the fourth transistor can be prevented from affecting light emission intensity of the light emitting element.

Application Example 6

An electronic apparatus according to the present application example includes the electro-optical device described in the above-described application example.

According to the configuration of the present application example, high quality of an image displayed in the electronic apparatus such as a head-mounted display can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to drawings. Note that, in each of the drawings below, to make each layer, member, and the like recognizable in terms of size, each of the layers, members, and the like are not to scale.

Outline of Electronic Apparatus

Figure 1:
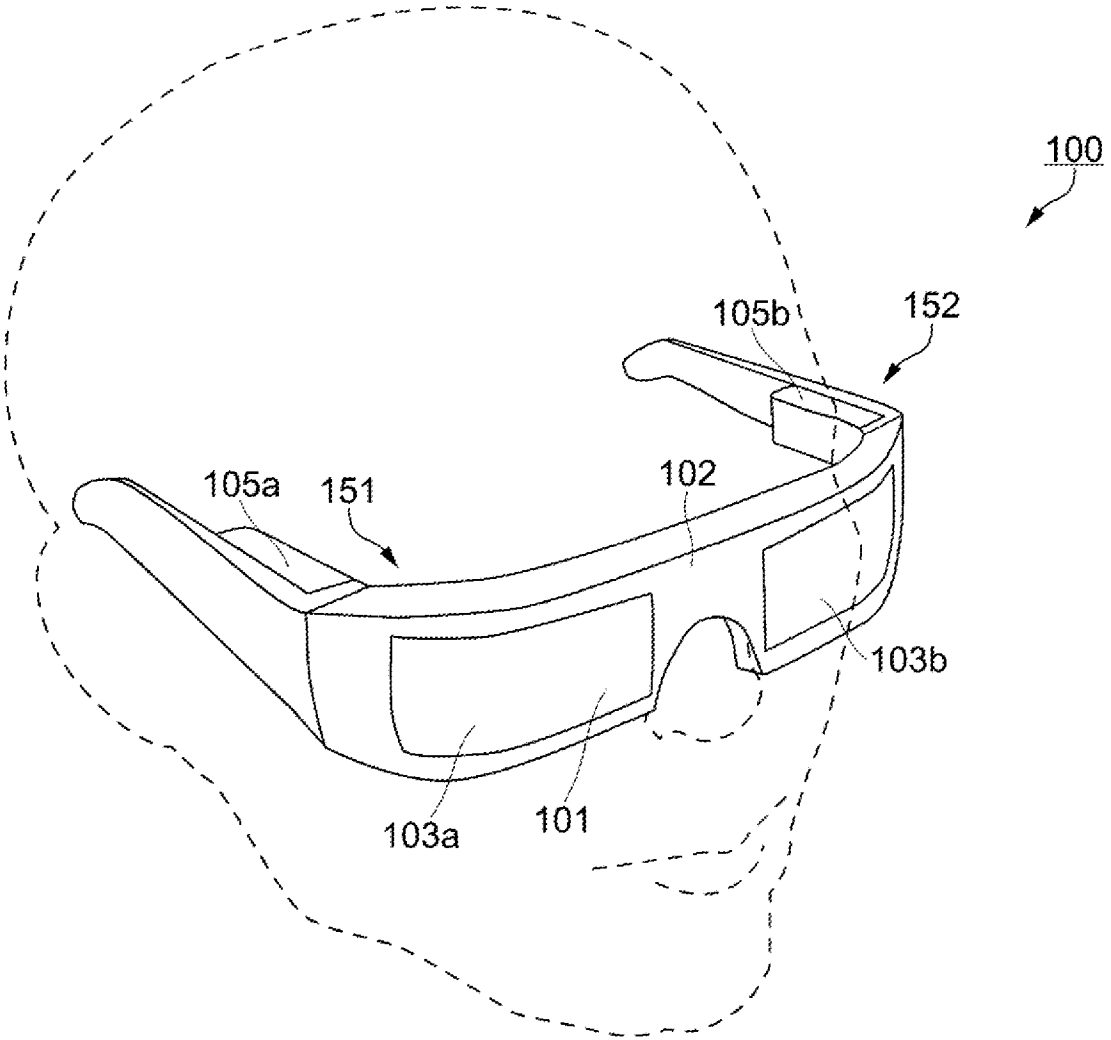
FIG. 1 is a diagram illustrating an overview of an electronic apparatus according to the present exemplary embodiment.

First, an outline of an electronic apparatus will be described with reference to FIG. 1. FIG. 1 is a diagram illustrating an overview of the electronic apparatus according to the present exemplary embodiment.

Figure 3:
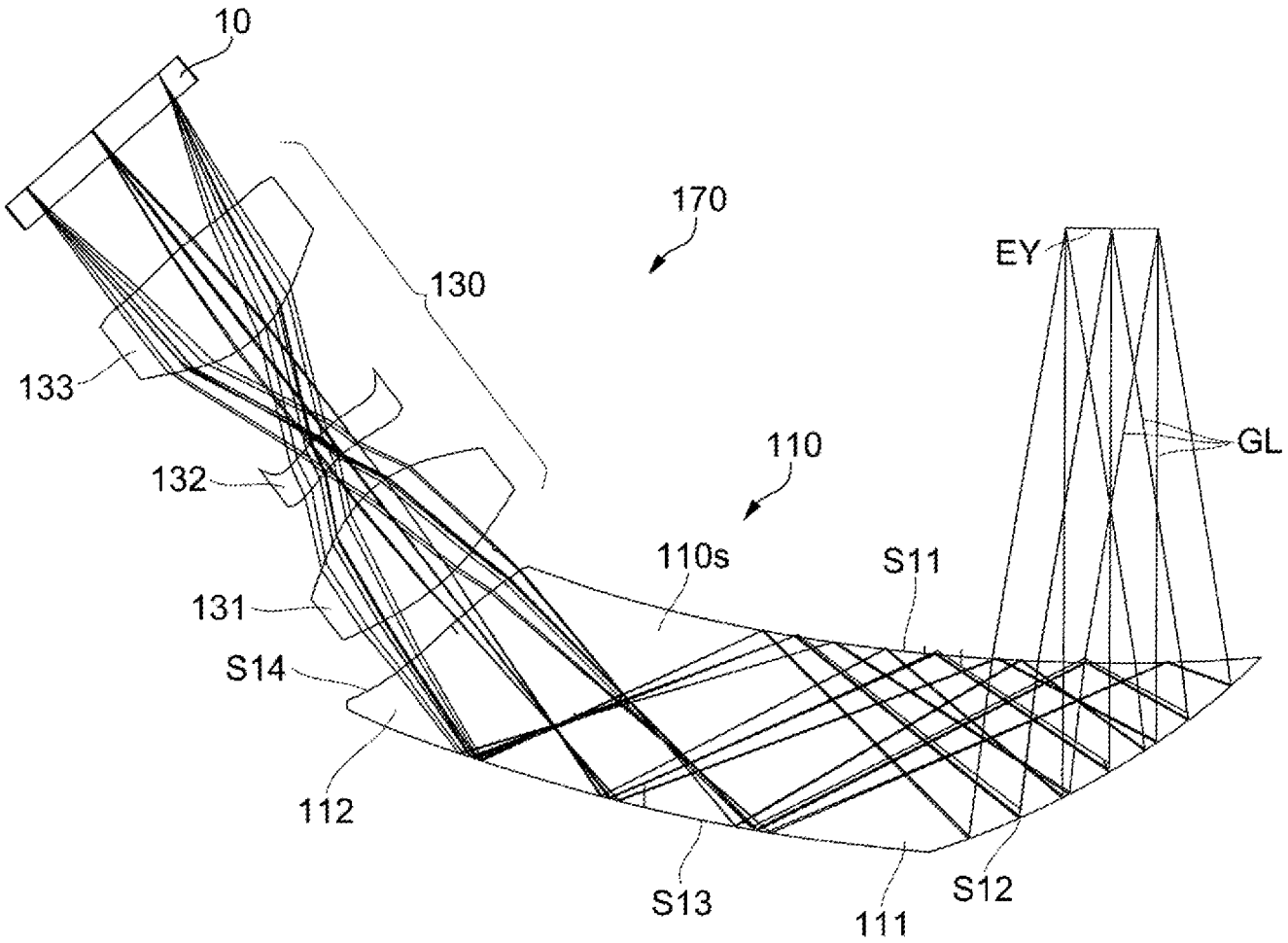
FIG. 3 is a diagram illustrating an optical system of the electronic apparatus according to the present exemplary embodiment.

A head-mounted display 100 is one example of the electronic apparatus according to the present exemplary embodiment, and includes an electro-optical device 10 (see FIG. 3). As illustrated in FIG. 1, the head-mounted display 100 has an external appearance similar to a pair of glasses. The head-mounted display 100 allows a user who wears the head-mounted display 100 to view image light GL of an image (refer to FIG. 3) and allows the user to view extraneous light as a see-through image. In other words, the head-mounted display 100 has a see-through function of superimposing the extraneous light over the image light GL to display an image, and has a small size and weight while having a wide angle of view and high performance.

The head-mounted display 100 includes a see-through member 101 that covers the front of the eyes of the user, a frame 102 that supports the see-through member 101, and a first built-in device unit 105*a* and a second built-in device unit 105*b* attached to respective portions of the frame 102 extending from cover portions at both left and right ends of the frame 102 over rear sidepieces (temples).

The see-through member 101 is a thick, curved optical member that covers the front of the eyes of the user, is also called a transparent eye cover, and is separated into a first optical portion 103*a* and a second optical portion 103*b*. A first display apparatus 151 illustrated on the left side of FIG. 1 that combines the first optical portion 103*a* and the first built-in device unit 105*a* is a portion that displays a see-through virtual image for the right eye and can alone serves as an electronic apparatus having a display function. A second display apparatus 152 illustrated on the right side of FIG. 1 that combines the second optical portion 103*b* and the second built-in device unit 105*b* is a portion that forms a see-through virtual image for the left eye and can alone serve as an electronic apparatus having a display function. The electro-optical device 10 (see FIG. 3) is incorporated in each of the first display apparatus 151 and the second display apparatus 152.

Internal Structure of Electronic Apparatus

Figure 2:
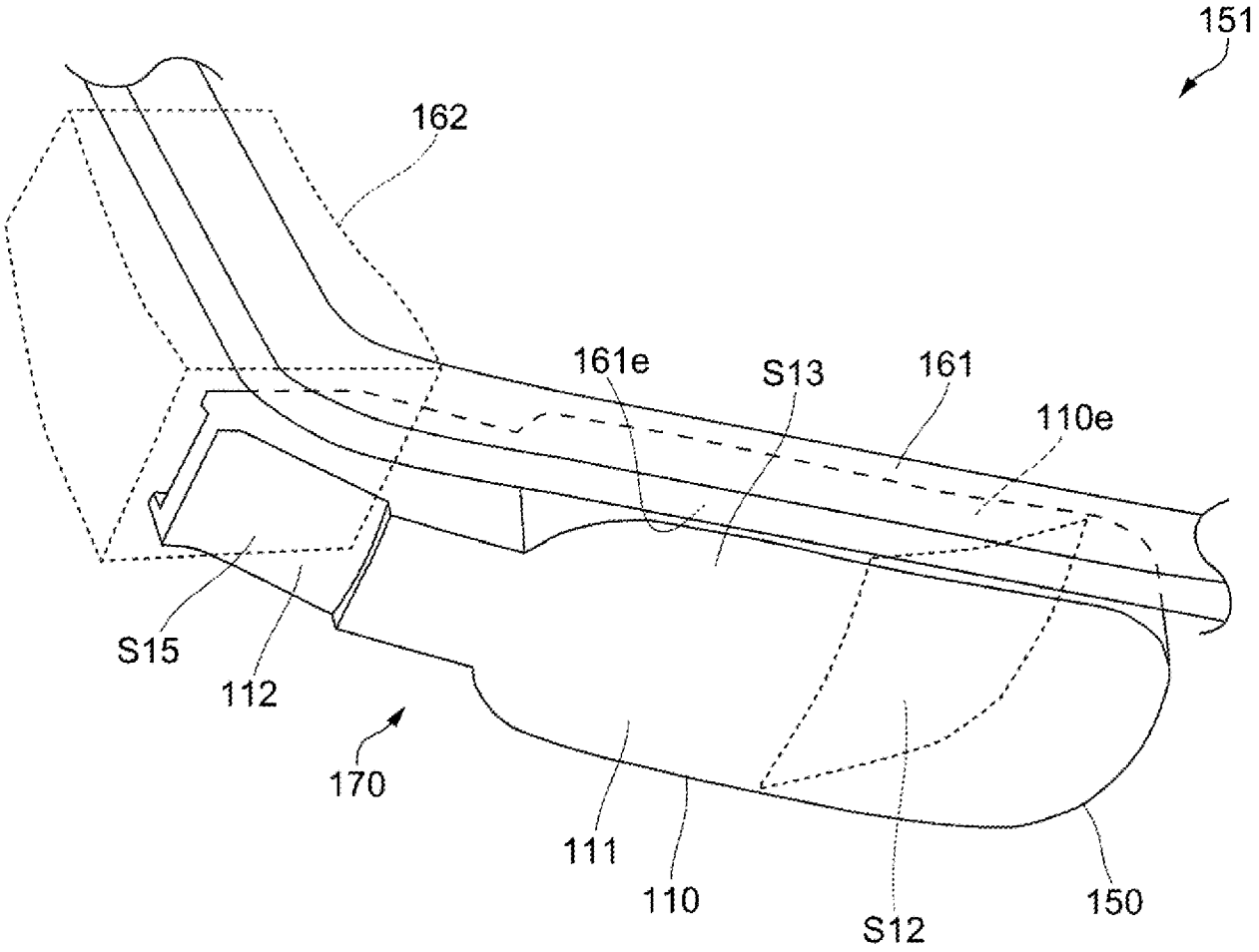
FIG. 2 is a diagram illustrating an internal structure of the electronic apparatus according to the present exemplary embodiment.

FIG. 2 is a diagram illustrating the internal structure of the electronic apparatus according to the present exemplary embodiment. FIG. 3 is a diagram illustrating an optical system of the electronic apparatus according to the present exemplary embodiment. Next, the internal structure and the optical system of the electronic apparatus will be described with reference to FIGS. 2 and 3. While FIG. 2 and FIG. 3 illustrate the first display apparatus 151 as an example of the electronic apparatus, the second display apparatus 152 is symmetrical to the first display apparatus 151 and has substantially the same structure. Accordingly, only the first display apparatus 151 will be described here and detailed description of the second display apparatus 152 will be omitted.

As illustrated in FIG. 2, the first display apparatus 151 includes a see-through projection device 170 and the electro-optical device 10 (see FIG. 3). The see-through projection device 170 includes a prism 110 to serve as a light-guiding member, a transparent member 150, and a projection lens 130 for image formation (see FIG. 3). The prism 110 and the transparent member 150 are integrated together by bonding and are securely fixed on a lower side of a frame 161 such that an upper surface 110*e* of the prism 110 contacts a lower surface 161*e* of the frame 161, for example.

The projection lens 130 is fixed to an end portion of the prism 110 through a lens tube 162 that houses the projection lens 130. The prism 110 and the transparent member 150 of the see-through projection device 170 correspond to the first optical portion 103*a* in FIG. 1. The projection lens 130 of the see-through projection device 170 and the electro-optical device 10 correspond to the first built-in device unit 105*a* in FIG. 1.

The prism 110 of the see-through projection device 170 is an arc-shaped member curved along the face in a plan view and may be considered to be separated into a first prism portion 111 on a central side close to the nose and a second prism portion 112 on a peripheral side away from the nose. The first prism portion 111 is disposed on a light emission side and includes a first surface S11 (see FIG. 3), a second surface S12, and a third surface S13 as side surfaces having an optical function.

The second prism portion 112 is disposed on a light incident side and includes a fourth surface S14 (see FIG. 3) and a fifth surface S15 as side surfaces having an optical function. Of these surfaces, the first surface S11 is adjacent to the fourth surface S14, the third surface S13 is adjacent to the fifth surface S15, and the second surface S12 is disposed between the first surface S11 and the third surface S13. Further, the prism 110 includes the upper surface 110*e* adjacent to the first surface S11 and the fourth surface S14.

The prism 110 is made of a resin material having high optical transparency in a visible range and is molded by, for example, pouring a thermoplastic resin in a mold, and solidifying the thermoplastic resin. While a main portion 110*s* (see FIG. 3) of the prism 100 is illustrated as an integrally formed member, it can be considered to be separated into the first prism portion 111 and the second prism portion 112. The first prism portion 111 can guide and emit the image light GL while also allowing for see-through of the extraneous light. The second prism portion 112 can receive and guide the image light GL.

The transparent member 150 is fixed integrally with the prism 110. The transparent member 150 is a member that assists a see-through function of the prism 110 and is also called an auxiliary prism. The transparent member 150 has high optical transparency in a visible range and is made of a resin material having substantially the same refractive index as the refractive index of the main portion 110*s* of the prism 110. The transparent member 150 is formed by, for example, molding a thermoplastic resin.

As illustrated in FIG. 3, the projection lens 130 includes, for example, three lenses 131, 132, and 133 along an incident side-optical axis. Each of the lenses 131, 132, and 133 is rotationally symmetric about a central axis of a light incident surface of the lens. At least one or more of the lenses 131, 132, and 133 is an aspheric lens.

The projection lens 130 allows the image light GL emitted from the electro-optical device 10 to enter the prism 110 and refocus the image on an eye EY. In other words, the projection lens 130 is a relay optical system for refocusing the image light GL emitted from each pixel of the electro-optical device 10 on the eye EY via the prism 110. The projection lens 130 is held inside the lens tube 162. The electro-optical device 10 is fixed to one end of the lens tube 162. The second prism portion 112 of the prism 110 is connected to the lens tube 162 holding the projection lens 130 and indirectly supports the projection lens 130 and the electro-optical device 10.

An electronic apparatus that is mounted on the head of the user and covers the front of the eyes, such as the head-mounted display 100, needs to be small and light. Further, the electro-optical device 10 used in an electronic apparatus such as the head-mounted display 100 needs to have a higher resolution, finer pixels, more gray-scales of display, and lower power consumption.

Configuration of Electro-Optical Device

Figure 4:
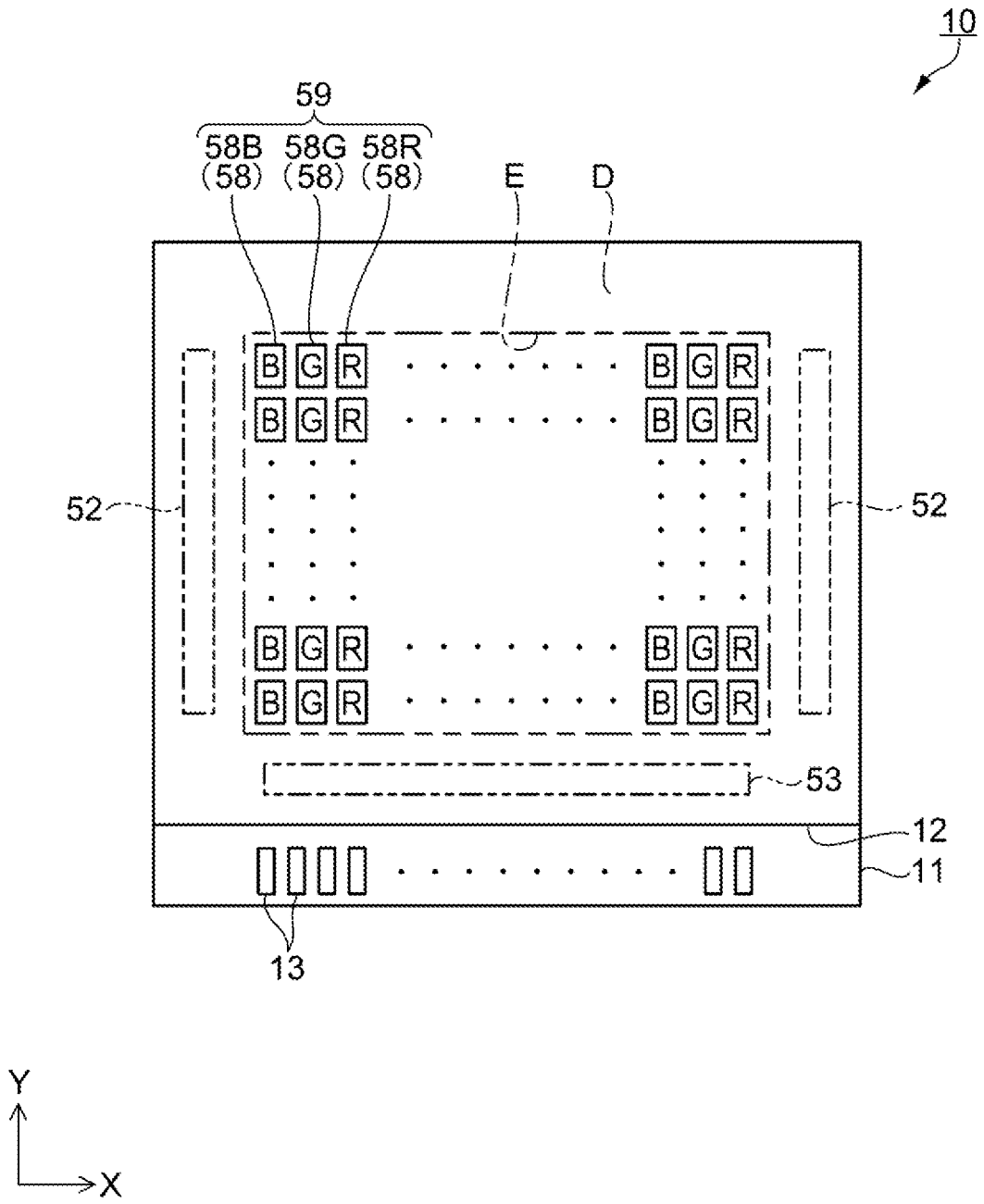
FIG. 4 is a schematic plan view illustrating a configuration of an electro-optical device according to the present exemplary embodiment.

Next, a configuration of an electro-optical device will be described with reference to FIG. 4. FIG. 4 is a schematic plan view illustrating the configuration of the electro-optical device according to the present exemplary embodiment. The present exemplary embodiment will be described by taking, as an example, a case where the electro-optical device 10 is an organic EL device including an organic EL element as a light emitting element. As illustrated in FIG. 4, the electro-optical device 10 according to the present exemplary embodiment includes an element substrate 11 and a protective substrate 12. The element substrate 11 is provided with a color filter, which is not illustrated. The element substrate 11 and the protective substrate 12 are disposed to face each other and bonded together with a filling agent, which is not illustrated.

The element substrate 11 is formed of, for example, a single-crystal semiconductor substrate such as a single-crystal silicon wafer. The element substrate 11 includes a display region E and a non-display region D surrounding the display region E. In the display region E a sub-pixel 58B that emits blue (B) light, a sub-pixel 58G that emits green (G) light, and a sub-pixel 58R that emits red (R) light are arranged in a matrix, for example. Each of the sub-pixel 58B, the sub-pixel 58G, and the sub-pixel 58R is provided with a light emitting element 20 (see FIG. 6). In the electro-optical device 10, a pixel 59 including the sub-pixel 58B, the sub-pixel 58G, and the sub-pixel 58R serves as a display unit to provide a full color display.

In this specification, the sub-pixel 58B, the sub-pixel 58G, and the sub-pixel 58R may not be distinguished from one another and may be collectively referred to as a sub-pixel 58. The display region E is a region through which light emitted from the sub-pixel 58 passes and that contributes to display. The non-display region D is a region through which light emitted from the sub-pixel 58 does not pass and that does not contribute to display.

The element substrate 11 is larger than the protective substrate 12 and a plurality of external connection terminals 13 are aligned along a first side of the element substrate 11 extending from the protective substrate 12. A data line drive circuit 53 is provided between the plurality of external connection terminals 13 and the display region E. A scan line drive circuit 52 is provided between the display region E and a second side or a third side, which is orthogonal to the first side, the second side and the third side being opposite to each other.

The protective substrate 12 is smaller than the element substrate 11 and is disposed so as to expose the external connection terminals 13. The protective substrate 12 is a transparent substrate, and, for example, a quartz substrate, a glass substrate, or the like is used as the protective substrate 12. The protective substrate 12 serves to protect the light emitting element 20 disposed in the sub-pixel 58 in the display region E from damage and is disposed to face at least the display region E.

Note that, a color filter may be provided on the light emitting element 20 in the element substrate 11 or provided on the protective substrate 12. When beams of light corresponding to colors are emitted from the light emitting element 20, a color filter is not essential. The protective substrate 12 is also not essential, and a protective layer that protects the light emitting element 20 may be provided instead of the protective substrate 12 on the element substrate 11.

In this specification, a direction along the first side on which the external connection terminals 13 are arranged is referred to as X direction or a row direction, and a direction along the second side and the third side as the other two sides perpendicular to the first side and opposite to each other is referred to as Y direction or a column direction. For example, the present exemplary embodiment adopts a so-called stripe arrangement in which the sub-pixels 58 that emit the same color are arranged in the Y direction as the column direction and the sub-pixels 58 that emit different colors are arranged in the X direction as the row direction.

Note that, the arrangement of the sub-pixels 58 in the X direction, i.e. the row direction, is not limited to the order of B, G, and R as illustrated in FIG. 4, but may be in the order of R, G, and B, for example. The arrangement of the sub-pixels 58 is not limited to the stripe arrangement, but may be a delta arrangement, a Bayer arrangement, or an S-stripe arrangement. In addition, the sub-pixels 58B, the sub-pixels 58G, and the sub-pixels 58R are not limited to the same shape or size.

Configuration of Circuit of Electro-Optical Device

Figure 5:
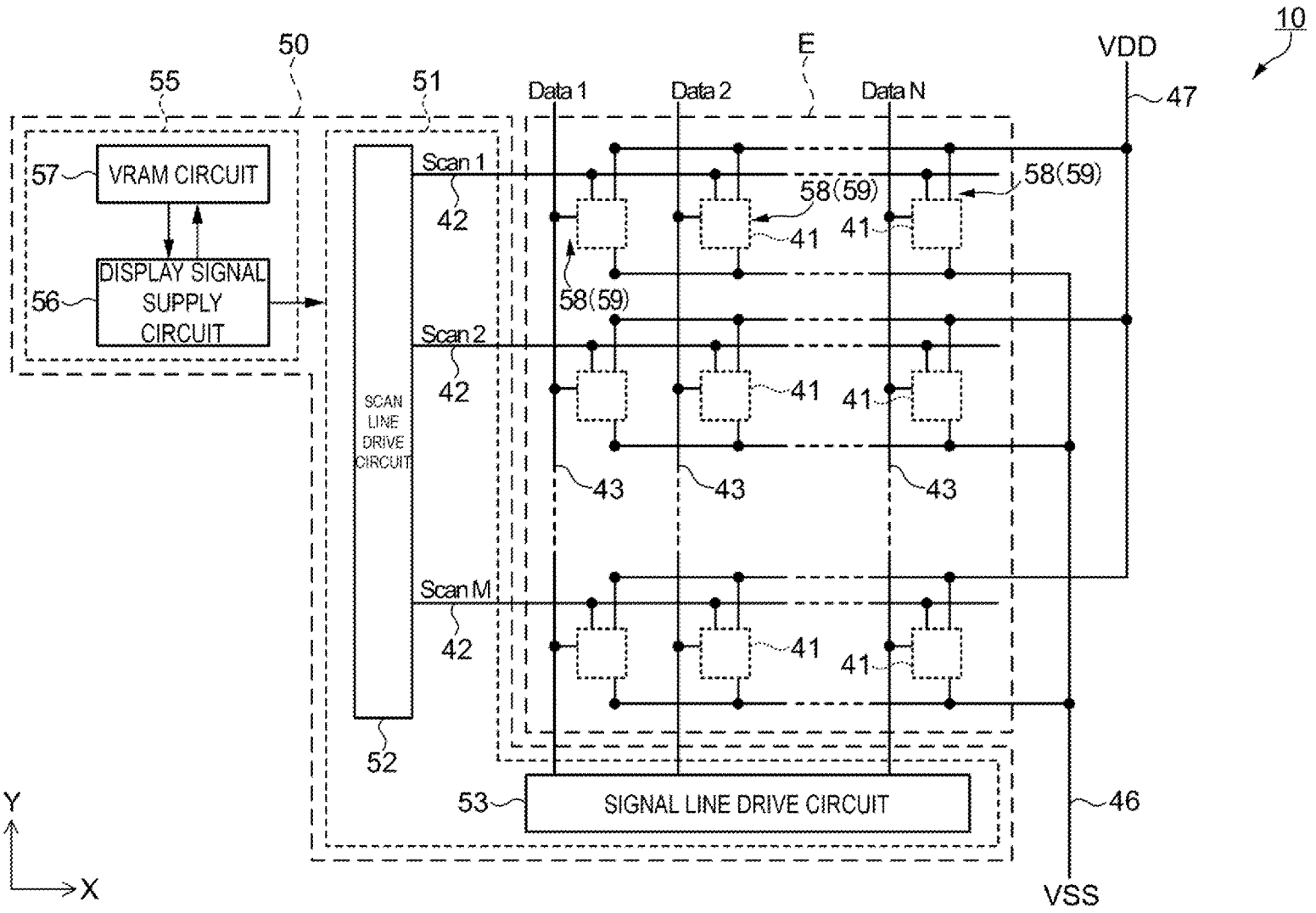
FIG. 5 is a block diagram of a circuit of the electro-optical device according to the present exemplary embodiment.

Next, a configuration of the circuit of the electro-optical device will be described with reference to FIG. 5. FIG. 5 is a block diagram of the circuit of the electro-optical device according to the present exemplary embodiment. As illustrated in FIG. 5, formed in the display region E of the electro-optic device 10 are a plurality of scan lines 42 and a plurality of data lines 43 that cross each other with the sub-pixels 58 being arranged in a matrix to correspond to the respective intersections of the scan lines 42 and the data lines 43. Each of the sub-pixels 58 includes a pixel circuit 41 including the light emitting element 20 (see FIG. 8) and the like. The scan lines 42 extend in the row direction. The data lines 43 extend in the column direction.

In the electro-optical device 10, the sub-pixels 58 in M rows×N columns are arranged in a matrix in the display region E. Specifically, M scan lines 42 and N data lines 43 are formed in the display region E. Note that, M and N are integers of two or greater, and as one example in the present exemplary embodiment, M=720 and N=1280×p, where p is an integer of one or greater and indicates the number of basic display colors. The present exemplary embodiment is described by taking, as an example, a case where p=3, that is, the basic display colors are three colors of R, G, and B.

The electro-optical device 10 includes a drive unit 50 outside the display region E. The driving unit 50 supplies various signals to the respective pixel circuits 41 arranged in the display region E to display an image. Pixels 59 that are formed with sub-pixels 58 for three colors serve as units of display for displaying an image in the display region E. The drive unit 50 includes a drive circuit 51 and a control unit 55. The control unit 55 supplies a display signal to the drive circuit 51. The drive circuit 51 supplies a drive signal that are based on the display signal to each of the pixel circuits 41 through the plurality of scan lines 42 and the plurality of data lines 43.

The drive circuit 51 includes the scan line drive circuit 52 and the data line drive circuit 53. The drive circuit 51 is provided in the non-display region D (see FIG. 4). In the present exemplary embodiment, the drive circuit 51 and the pixel circuit 41 are formed on the element substrate 11 illustrated in FIG. 4. In the present exemplary embodiment, a single-crystal silicon wafer is used as the element substrate 11. Specifically, the drive circuit 51 and the pixel circuit 41 are each formed of an element such as a transistor formed on the single-crystal silicon wafer.

The scan lines 42 are electrically connected to the scan line drive circuit 52. The scan line drive circuit 52 outputs a scan signal (Scan) to respective scan lines 42. The scan signal allows the pixel circuits 41 in the row direction to be selected or unselected. The scan lines 42 transmit the scan signals to the pixel circuits 41. In this way, the scan signal has a selection signal as a selection state and a non-selection signal as a non-selection state. The scan line 42 is appropriately selected by receiving the scan signal from the scan line drive circuit 52.

Furthermore, a low potential line 46 as a first potential line and a high potential line 47 as a second potential line are arranged in the non-display region D and the display region E. The low potential line 46 supplies a first potential (V1) to each of the pixel circuits 41, and the high potential line 47 supplies a second potential (V2) different from the first potential to each of the pixel circuits 41. In the present exemplary embodiment, the first potential (V1) is a low potential VSS (V1=VSS=2.0 V as one example), and the second potential (V2) is a high potential VDD (V2=VDD=7.0 V as one example).

While the low potential line 46 and the high potential line 47 extend in the row direction within the display region E as one example in the present exemplary embodiment, they may extend in the column direction; some of them may extend in the row direction while the other extend in the column direction; or they may be arranged in a grid pattern in the row and column directions.

Note that, to specify a scan signal supplied to a scan line 42 in an i-th row out of the M scan lines 42, the scan signal in the i-th row is named as a scan signal Scan i. The scan line drive circuit 52 includes a shift register circuit, which is not illustrated, and a signal that is shifted on the shift register circuit is output as a shift output signal at each stage. The shift output signals are then used to generate scan signals from Scan 1 in a first row to Scan M in an M-th row.

The data line 43 is electrically connected to the data line drive circuit 53. The data line drive circuit 53 includes a shift register circuit, a decoder circuit, or a demultiplexer circuit, which is not illustrated. The data line drive circuit 53 supplies an image signal (Data) to each of the N data lines 43 in synchronization with selection of the scan line 42. The image signal is a digital signal having a potential of the first potential or the second potential. The first potential is VSS and the second potential is VDD in the present exemplary embodiment. Note that, to specify an image signal supplied to a data line 43 in a j-th column out of the N data lines 43, the image signal in the j-th column is named as an image signal Data j.

The control unit 55 includes a display signal supply circuit 56 and a video random access memory (VRAM) circuit 57. The VRAM circuit 57 temporarily stores a frame image and the like. The display signal supply circuit 56 generates a display signal, such as an image signal and a clock signal, from a frame image temporarily stored in the VRAM circuit 57 and supplies the display signal to the drive circuit 51.

In the present exemplary embodiment, the drive circuit 51 and the pixel circuit 41 are formed on the element substrate 11. In the present exemplary embodiment, a single-crystal silicon wafer is used as the element substrate 11. Specifically, the drive circuit 51 and the pixel circuits 41 are each formed of a transistor element formed on the single-crystal silicon wafer.

The control unit 55 is formed of a semiconductor integrated circuit formed on a substrate (not illustrated) formed of a single crystal semiconductor substrate different from the element substrate 11. The substrate on which the control unit 55 is formed is connected to the external connection terminals 13 provided on the element substrate 11 with a flexible printed circuit (FPC). A display signal is supplied from the control unit 55 to the drive circuit 51 through this flexible printed circuit.

Configuration of Pixel

Figure 6:
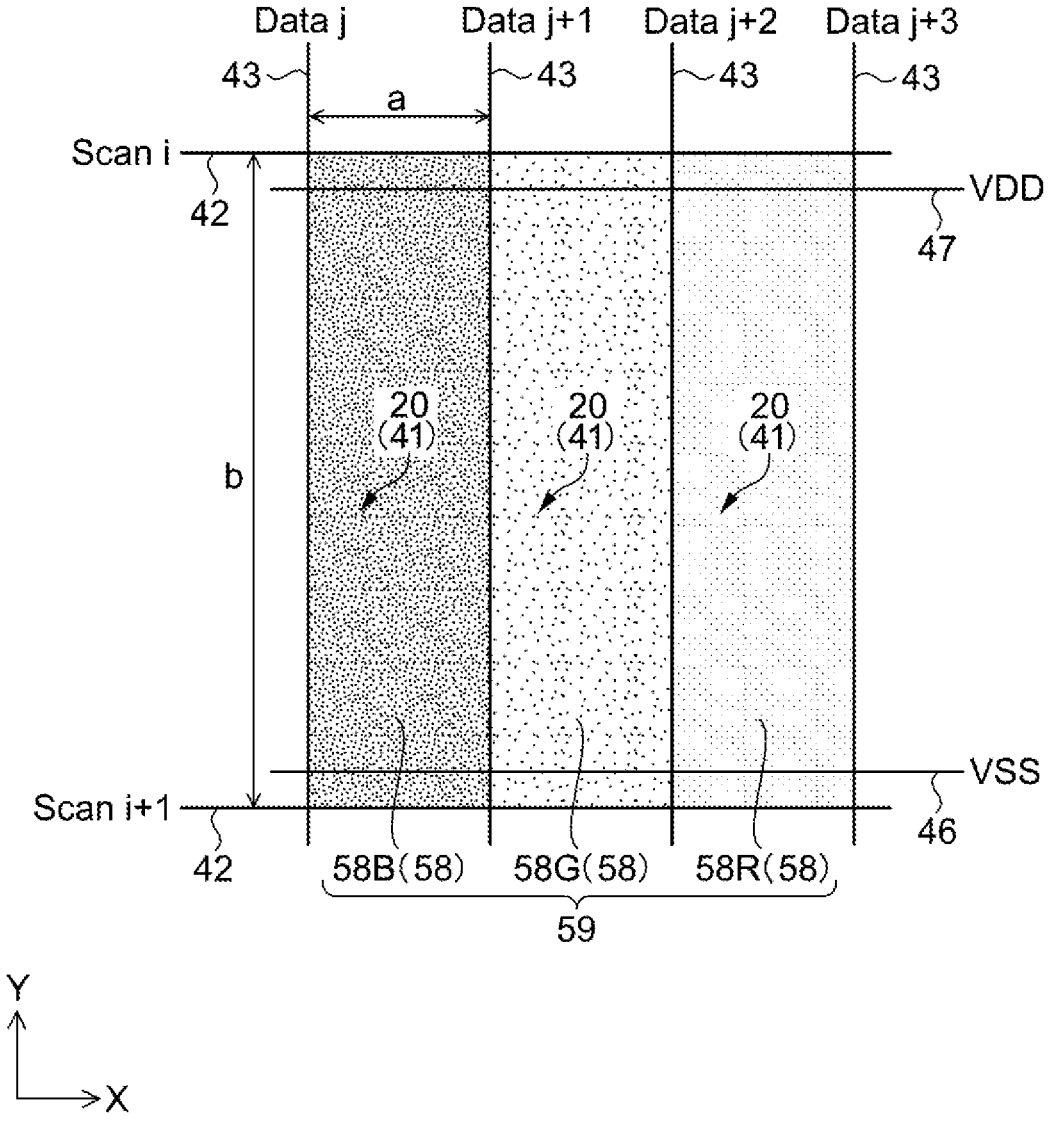
FIG. 6 is a diagram illustrating a configuration of a pixel according to the present exemplary embodiment.

Next, a configuration of a pixel according to the present exemplary embodiment will be described with reference to FIG. 6. FIG. 6 is a diagram illustrating the configuration of the pixel according to the present exemplary embodiment.

As described above, in the electro-optic device 10, the pixel 59 including the sub-pixels 58 (the sub-pixel 58B, the sub-pixel 58G, and the sub-pixel 58R) forms a unit of display to display an image. In the present exemplary embodiment, the length a of the sub-pixel 58 in the X direction as the row direction is 4 micrometers (μm) and the length b of the sub-pixel 58 in the Y direction as the column direction is 12 micrometers (μm). The pitch at which the sub-pixels 48 are arranged in the X direction as the row direction is 4 micrometers (μm) and the pitch at which the sub-pixels 48 are arranged in the Y direction as the column direction is 12 micrometers (μm).

Each of the sub-pixels 58 includes the pixel circuit 41 including the light emitting element (LED) 20. The light emitting element 20 emits white light. The electro-optical device 10 includes a color filter (not illustrated) through which light emitted from the light emitting element 20 passes. The color filter includes color filters in colors corresponding to basic display colors p. In the present exemplary embodiment, the basic colors p=3, and color filters in respective colors of B, G, and R are disposed in the corresponding sub-pixels 58B, 58G, and 58R.

In the present exemplary embodiment, an organic electro luminescence (EL) element is used as one example of the light emitting element 20. The organic EL element may have an optical resonant structure that amplifies the intensity of light having a specific wavelength. Specifically, the organic EL element may be configured such that a blue light is extracted from the white light emitted from the light emitting element 20 in the sub-pixel 58B; a green light is extracted from the white light emitted from the light emitting element 20 in the sub-pixel 58G; and a red light is extracted from the white light emitted from the light emitting element 20 in the sub-pixel 58R.

In addition to the above-described example, assuming that basic color p=4, the sub-pixel 58 substantially without a color filter may be prepared as a color filter for a color other than B, G, and R, for example, a color filter for white light, or the sub-pixel 58 including a color filter for light in another color such as yellow and cyan may be prepared. Furthermore, a light emitting diode element such as gallium nitride (GaN) and a semiconductor laser element, may be used as the light emitting element 20.

Digital Driving of Electro-Optical Device

Figure 7:
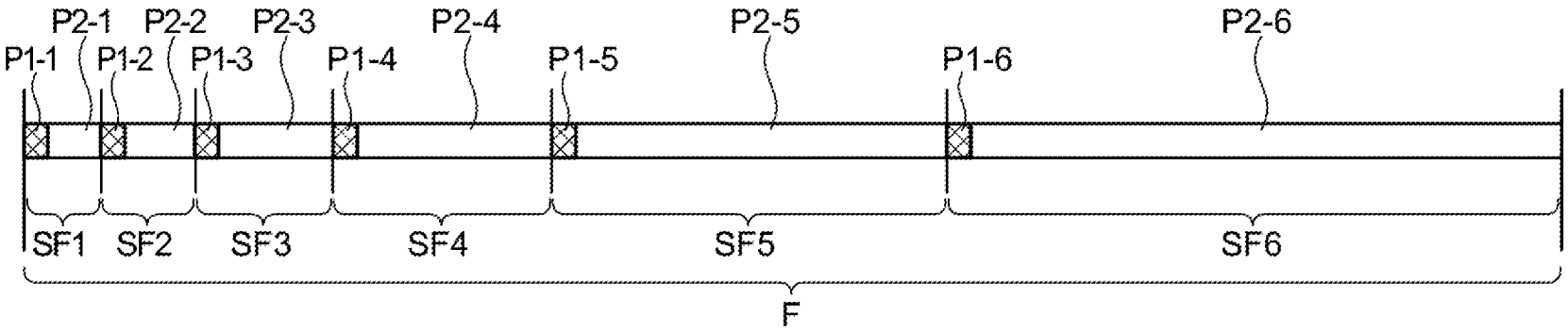
FIG. 7 is a diagram illustrating digital driving of the electro-optical device according to the present exemplary embodiment.

Next, a method for displaying an image by digital driving in the electro-optical device 10 according to the present exemplary embodiment will be described with reference to FIG. 7. FIG. 7 is a diagram illustrating the digital driving of the electro-optical device according to the present exemplary embodiment.

The electro-optical device 10 displays an image on the display region E (see FIG. 4) using a digital driving method. The light emitting element 20 (see FIG. 6) disposed in each of the sub-pixels 58 has either a binary state of emission as bright state or non-emission as dark state, so that the gray-scale of a displayed image depends on the ratio of emission period of each of the light emitting elements 20. This is referred to as time division driving.

As illustrated in FIG. 7, in the time division driving, one field (F) that displays one image is divided into a plurality of subfields (SFs) and the gray-scale is expressed by controlling emission and non-emission of the light emitting element 20 for each of the subfields (SFs). An example in which an image that possesses $2^6$=64 gray-scales is displayed by a 6-bit time division gray-scale scheme will be described here. In the 6-bit time division gray-scale scheme, one field F is divided into six subfields, namely SF1 to SF6.

In FIG. 7, an i-th subfield in the one field F is named as SFi and the six subfields from the first subfield SF1 to the sixth subfield SF6 are illustrated. Each of the subfields SF includes a display period P2, which is a second period and indicated by P2-1 to P2-6. In addition, each of the subfields SF can include a signal writing period P1, which is a non-display period, i.e. a first period, and indicated by P1-1 to P1-6, if the signal writing period P1 is necessary.

Note that, the subfields SF1 to SF6 may not be distinguished from one another and may be collectively referred to as a subfield SF, the non-display periods P1-1 to P1-6 may not be distinguished from one another and may be collectively referred to as a non-display period P1, and the display periods P2-1 to P2-6 may not be distinguished from one another and may be collectively referred to as a display period P2 in this specification.

The light emitting element 20 is either in the emission or non-emission state during the display period P2 and in the non-emission state during the non-display period P1, which is the signal-writing period. The non-display period P1 is a period used to write an image signal to the memory circuit 60 (see FIG. 8). During this period one of the M scan lines 42 (see FIG. 5) is selected by receiving a scan signal from the scan line drive circuit 52 (see FIG. 5). The non-display period P1 is a period during which one of the scan lines 42 is selected. The display period P2 is a period used to display. During the display period P2 the light emitting element 20 is either in the emission or non-emission state. The shortest display period P2 is one vertical period, during which all the scan lines 42 are selected once.

In the 6-bit time division gray-scale scheme, the display period P2 (P2-1 to P2-6) of each of the subfields SFs is set such that (P2-1 of SF1):(P2-2 of SF2):(P2-3 of SF3):(P2-4 of SF4):(P2-5 of SF5):(P2-6 of SF6)=1:2:4:8:16:32. When an image is displayed by a progressive scheme having a frame frequency of 30 Hz, one frame=one field (F)=33.3 milliseconds (msec), for example.

In the above-described example, assuming that the non-display period P1 (P1-1 to P1-6) of each of the subfields SF is 0.5 microseconds, the display periods P2 are set such that (P2-1 of SF1)=0.529 milliseconds, (P2-2 of SF2)=1.058 milliseconds, (P2-3 of SF3)=2.116 milliseconds, (P2-4 of SF4)=4.232 milliseconds, (P2-5 of SF5)=8.465 milliseconds, and (P2-6 of SF6)=16.93 milliseconds.

Herein, the duration of the non-display period P1 is x (sec), and the duration of the shortest display period P2 is y (sec). In the above-described example, the shortest display period P2 is the display period P2-1 in the first subfield SF1. Given that the bit number in gray-scale as the number of subfields SF is g and the field frequency is f (Hz), the relationship among them is expressed by Equation 1 below:

[Equation 1]

$$gx+(2^g-1)y=1/f \quad (1)$$

In the digital driving of the electro-optical device 10, a gray-scale image is displayed based on the ratio of a light emission period to a total display period P2 within one field F. For example, for black state with a gray-scale of "0," the light emitting element 20 is placed into non-emission in all of the display periods P2-1 to P2-6 of the six subfields SF1 to SF6. On the other hand, for white state with a gray-scale of "63," the light emitting element 20 is placed into emission during all of the display periods P2-1 to P2-6 of the six subfields SF1 to SF6.

To display an image with an intermediate gray-scale of, for example, "7" out of 64 gray-scales, the light emitting element 20 is caused to emit light during the display periods P2-1, P2-2, and P2-3 of the first, second and third subfields SF1, SF2, and SF3, respectively, and the light emitting element 20 is placed into non-emission during the display periods P2-4 to P2-6 of the other subfields SF4 to SF6. In this way, an image with an intermediate gray-scale is displayed by appropriately selecting emission or no-emission of the light emitting element 20 during the display period P2 for each of the subfields SF constituting the one field F.

According to an organic EL device as a typical analog driven electro-optical device in prior art, gray-scale display is performed by analog control of a current flowing through an organic EL element according to the gate potential of a driving transistor, such that any variation in current-voltage characteristics and threshold voltage of the driving transistor may cause a variation in brightness and shift in gray-scale between pixels, resulting in a decreased display quality. On the other hand, when a compensating circuit that compensates for variations in current-voltage characteristics and threshold voltage of a driving transistor is provided as described in JP-A-2004-062199, a current also flows through the compensating circuit, causing an increase in power consumption.

Also, in the typical organic EL device in prior art, an electric capacitance of a capacitive element that stores an image signal as an analog signal has to large in order to display many gray-scales of display. This requirement is a trade-off with high resolution and fine pixels and may result in an increase in power consumption due to charging and discharging of the capacitive element. In other words, in a typical organic EL device in prior art, an electro-optical device capable of displaying a high-resolution, multi-gray-scale, and high-quality image at low power consumption is difficult to achieve.

In the electro-optical device 10 according to the present exemplary embodiment, the light emitting element 20 is operated based on binary values of ON and OFF, so that the light emitting element 20 is placed into either binary emission or non-emission states. Thus, the electro-optical device 10 is less affected by variations in current-voltage characteristics or threshold voltage of a transistor than electro-optical device 10 operated by analog driving, so that a high-quality image with less variations in brightness and less shift in gray-scale between the pixels 59, namely, the sub-pixels 58, is obtained. Furthermore, since a capacitive element in digital driving does not need to have a large capacitance as required in analog driving, not only can a finer pixel 59, namely, finer sub-pixels 58, be achieved, but the resolution can also be easily improved and the power consumption due to charging and discharging of a large capacitive element can be reduced.

Furthermore, the number of gray-scales can be easily increased by increasing the number g of the subfields SF constituting the one field F in digital driving of the electro-optical device 10. In this case, with the non-display period P1 as described above, the number of gray-scales can be increased by simply shortening the shortest display period P2. For example, when display is performed with 256 gray-scales assuming that g=8 in the progressive scheme at the frame frequency f=30 Hz, the duration y of P2-1 of SF1, which is the shortest display period, may be simply set to 0.131 milliseconds by Equation 1 assuming that duration x of the non-display period P1=0.5 microseconds.

As described later, in digital driving of the electro-optical device 10, the non-display period P1 as the first period may be assigned to a signal-writing period during which an image signal is written in the memory circuit 60 or a signal-rewriting period during which an image signal is rewritten. Thus, 6-bit gray-scale display can be easily switched to 8-bit gray-scale display without changing the signal-writing period. In other words, 6-bit gray-scale display can be easily switched to 8-bit gray-scale display without changing the clock frequency of the drive circuit 51.

Furthermore, in digital driving of the electro-optical device 10, the image signal in the memory circuit 60 (see FIG. 8) of a sub-pixel 58 for which display is to be changed is rewritten among the subfields SF or among the fields F. On the other hand, the image signal in the memory circuit 60 of a sub-pixel 58 for which display is not to be changed is not rewritten, that is to say, the image signal is maintained. As a result, the power consumption can be reduced. Accordingly, this configuration can achieve the electro-optical device 10 that can reduce energy consumption and display a multi-gray-scale and high-resolution image with less variation in brightness and less shift in gray-scale between the pixels 59, namely, the sub-pixels 58.

Example 1

Configuration of Pixel Circuit

Figure 8:
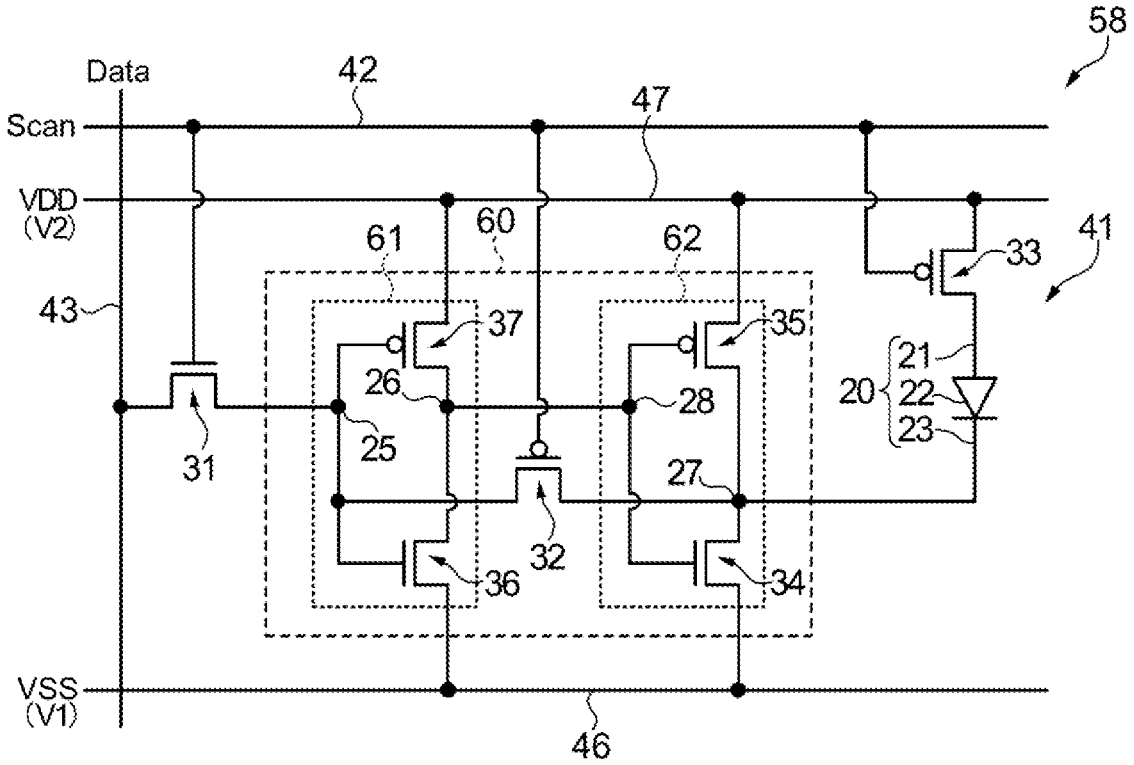
FIG. 8 is a diagram illustrating a configuration of a pixel circuit according to Example 1.

Next, a configuration of a pixel circuit according to Example 1 will be described. First, a configuration of a pixel circuit according to Example 1 will be described with reference to FIG. 8. FIG. 8 is a diagram illustrating the configuration of the pixel circuit according to Example 1.

As illustrated in FIG. 8, a pixel circuit 41 is provided for each of sub-pixels 58 disposed at intersections of scan lines 42 and data lines 43. A scan line 42 and a data line 43 correspond to each of the pixel circuits 41. To each of the pixel circuits 41, the low potential line 46 supplies the first potential (V1) and the high potential line 47 supplies the second potential (V2). As described above, in the present exemplary embodiment (Example 1), the first potential is V1=VSS=2.0 V, and the second potential is V2=VDD=7.0 V as one example.

The pixel circuit 41 according to Example 1 includes the light emitting element 20, a first N-type transistor 31, a memory circuit 60, and a third P-type transistor 33. The memory circuit 60 incorporated in the pixel circuit 41 enables digital driving of the electro-optical device 10 and helps reduce the variation in the luminance of the light emitting element 20 among the sub-pixels 58 as compared to analog driving, and thus, the variation in display among the pixels 59 can be reduced.

The light emitting element 20 is an organic EL element in Example 1, and includes an anode 21 as a pixel electrode, a light emitting section 22 as a light emission functional layer, and a cathode 23 as a counter electrode. The light emitting section 22 is configured to emit light by a part of energy being discharged as fluorescence or phosphorescence when an exciton is formed by a positive hole injected from the anode 21 side and an electron injected from the cathode 23 side and the exciton disappears, that is, when the positive hole recombines with the electron.

In the pixel circuit 41 according to Example 1, the light emitting element 20 is disposed between an output terminal 27 of a second inverter 62 of the memory circuit 60 and the second potential line (high potential line 47). The anode 21 of the light emitting element 20 is electrically connected to a drain of the third transistor 33. The cathode 23 of the light emitting element 20 is electrically connected to the output terminal 27 of the second inverter 62. The output terminal 27 is electrically connected to drains of the fourth transistor 34 and the fifth transistor 35. In the pixel circuit 41 according to Example 1, the cathode 23 corresponds to a first terminal of the light emitting element 20.

The memory circuit 60 is disposed between the first potential line (low potential line 46) and the second potential line (high potential line 47). The memory circuit 60 includes a first inverter 61, the second inverter 62, and a second transistor 32 of the P-type. The memory circuit 60 includes these two inverters 61 and 62 connected to each other in a circle to constitute a so-called static memory that stores an image signal, which is a digital signal for the light emitting element 20.

An output terminal 26 of the first inverter 61 is electrically connected to an input terminal 28 of the second inverter 62. The second transistor 32 is disposed between the output terminal 27 of the second inverter 62 and an input terminal 25 of the first inverter 61. In other words, one of the source and the drain of the second transistor 32 is electrically connected to the input terminal 25 of the first inverter 61, and the other is electrically connected to the output terminal 27 of the second inverter 62.

In this specification, the state where a terminal A (such as an output or input terminal) and a terminal B (such as an output or input terminal) are electrically connected to each other means a state where the logic of the terminal A and the logic of the terminal B can be equal. For example, even when a transistor, a resistor, a diode, and the like are arranged between the terminal A and the terminal B, the terminals is regarded as a state of electrically connected if the logics of the terminals are the same. Further, "dispose" as used in the expression "a transistor and other elements are disposed between A and B" does not mean how these elements are arranged on an actual lay-out, but means how these elements are arranged in a circuit diagram.

An image signal stored in the memory circuit 60 is a digital signal and has a binary value of High or Low. In Example 1, the light emitting element 20 is in a state that allows emission when the potential of the output terminal 26 of the first inverter 61 to which the input terminal 28 of the second inverter 62 is electrically connected is High, that is, when the potential of the output terminal 27 of the second inverter 62 is Low. The light emitting element 20 is in a non-emission state when the potential of the output terminal 26 of the first inverter 61 to which the input terminal 28 of the second inverter 62 is connected is Low, that is, when the potential of the output terminal 27 of the second inverter 62 is High.

In Example 1, the two inverters 61 and 62 constituting the memory circuit 60 are disposed between the first potential line (low potential line 46) and the second potential line (high potential line 47) and VSS as the first potential (V1) and VDD as the second potential (V2) are supplied to the two inverters 61 and 62. Therefore, High of the image signal corresponds to the second potential (VDD) and Low corresponds to the first potential (VSS).

The first inverter 61, which includes a sixth N-type transistor 36 and a seventh P-type transistor 37, has a CMOS configuration. The sixth transistor 36 and the seventh transistor 37 are disposed in series between the first potential line (low potential line 46) and the second potential line (high potential line 47). The source of the sixth transistor 36 is electrically connected to the first potential line (low potential line 46). The source of the seventh transistor 37 is electrically connected to the second potential line (high potential line 47).

Note that, the source potential is compared with the drain potential and the one having a lower potential is the source in the N-type transistor. A source potential is compared with a drain potential and the one having a higher potential is a source in the P-type transistor.

The second inverter 62, which includes a fourth N-type transistor 34 and a fifth P-type transistor 35, has a CMOS configuration. The fourth transistor 34 and the fifth transistor 35 are disposed in series between the first potential line (low potential line 46) and the second potential line (high potential line 47). The source of the fourth transistor 34 is electrically connected to the first potential line (low potential line 46). The source of the fifth transistor 35 is electrically connected to the second potential line (high potential line 47). As described later, the fourth transistor 34 also functions as a driving transistor of the light emitting element 20.

The input terminal 25 of the first inverter 61, which serves as the gate of the sixth transistor 36 and the seventh transistor 37, is electrically connected to one of the source and the drain of the second transistor 32. The output terminal 26 of the first inverter 61, which serves as the drain of the sixth transistor 36 and the seventh transistor 37, is electrically connected to the input terminal 28 of the second inverter 62.

The input terminal 28 of the second inverter 62, which serves as the gate of the fourth transistor 34 and the fifth transistor 35, is electrically connected to the output terminal 26 of the first inverter 61. The output terminal 27 of the second inverter 62, which serves as the drain of the fourth transistor 34 and the fifth transistor 35, is electrically connected to the other of the source and the drain of the second transistor 32. The output terminal 27 of the second inverter 62 is electrically connected to the cathode 23, i.e. first terminal, of the light emitting element 20.

The gate of the second transistor 32 is electrically connected to the scan line 42. While the second transistor 32 is in the ON-state, the input terminal 25 of the first inverter 61 (namely, the gate of the sixth transistor 36 and the gate of the seventh transistor 37) and the output terminal 27 of the second inverter 62 (namely, the drain of the fourth transistor 34 and the drain of the fifth transistor 35) are electrically connected to each other.

Both of the first inverter 61 and the second inverter 62 in Example 1 have the CMOS configuration. In addition to this configuration the inverters 61 and 62 may be formed of a transistor and a resistor. For example, one of the sixth transistor 36 and the seventh transistor 37 in the first inverter 61 may be replaced with a resistor, or the fifth transistor 35 in the second inverter 62 may be replaced with a resistor.

The first transistor 31 is a selection transistor for the pixel circuit 41. The first transistor 31 is disposed between the input terminal 25 of the first inverter 61 of the memory circuit 60 and the data line 43. In other words, one of the source and the drain of the first transistor 31 is electrically connected to the data line 43 while the other is electrically connected to the input terminal 25 of the first inverter 61 (namely, the gate of the sixth transistor 36 and the seventh transistor 37). The gate of the first transistor 31 is electrically connected to the scan line 42.

The first transistor 31 is the N-type as a first conductive type, and the second transistor 32 is the P-type as a second conductive type different from the first conductive type. The gate of the first transistor 31 and the gate of the second transistor 32 are electrically connected to the scan line 42. The first transistor 31 and the second transistor 32 operate in a complementary manner to each other in response to a scan signal (selection signal or non-selection signal) supplied to the scan line 42.

In Example 1, since the first transistor 31 that serves as the selection transistor is the N-type, the scan signal in the selection state, i.e. selection signal, is High (a high potential) and the scan signal in the non-selection state, i.e. non-selection signal, is Low (a low potential). While the selection signal is supplied to the scan line 42, the first transistor 31 is in the ON-state, and the second transistor 32 is in the OFF-state. While the non-selection signal is supplied to the scan line 42, the first transistor 31 is in the OFF-state, and the second transistor 32 is placed into the ON-state.

When the selection signal is supplied to the scan line 42 and the first transistor 31 is turned into the ON-state, the data line 43 electrically connected to the input terminal 25 of the first inverter 61 so that the image signal is introduced from the data line 43 to the memory circuit 60 through the first transistor 31. When the image signal of Low is introduced to the input terminal 25 of the first inverter 61, the potential of the output terminal 26 of the first inverter 61 (=the input terminal 28 of the second inverter 62) becomes High and the potential of the output terminal 27 of the second inverter 62 becomes Low. Upon this, since the second transistor 32 is in the OFF-state, the input terminal 25 of the first inverter 61 is disconnected from the output terminal 27 of the second inverter 62.

When the non-selection signal is supplied to the scan line 42 and the second transistor 32 is turned into the ON-state, the input terminal 25 of the first inverter 61 is electrically connected to the output terminal 27 of the second inverter 62. If the potential of the output terminal 27 of the second inverter 62 is Low, the potential of the input terminal 25 of the first inverter 61 is Low or close to Low, such that the potential of the output terminal 26 of the first inverter 61 (=the input terminal 28 of the second inverter 62) is High, and thus the output terminal 27 of the second inverter 62 stably keeps Low potential. Upon this, since the first transistor 31 is in the OFF-state, the input terminal 25 of the first inverter 61 is electrically disconnected from the data line 43 to prevent the image signal from being introduced to the memory circuit 60. Therefore, the image signal stored in the memory circuit 60 is maintained in a stable state until the new image signal is introduced next time.

Note that, as will be described later, it is preferable to set the drive conditions such as a potential of the non-selection signal such that the second transistor 32 is in the ON-state independent from whether the type of the image signal to be maintained is High or Low. In this way, the signal stored in the memory circuit 60 is maintained reliably.

It is preferable that the third transistor 33 and the second transistor 32 is the same conductive type. The third transistor 33 is a control transistor that controls emission of the light emitting element 20. The third transistor 33 is disposed in series with the light emitting element 20 between the output terminal 27 of the second inverter 62 and the second potential line (high potential line 47). The source of the third transistor 33 is electrically connected to the second potential line (high potential line 47). The drain of the third transistor 33 is electrically connected to the anode 21 of the light emitting element 20. In other words, the third P-type transistor 33 is disposed on the high potential side with respect to the light emitting element 20.

The third transistor 33 is the second conductive type which is the P-type in this Example. The gate of the third transistor 33 is electrically connected to the scan line 42. The first transistor 31 and the third transistor 33 operate in a complementary manner to each other in response to a scan signal (a selection signal or a non-selection signal) as supplied to the scan line 42. While the selection signal is supplied to the scan line 42, the first transistor 31 is in the ON-state and the third transistor 33 is in the OFF-state. Upon this, the light emitting element 20 does not emit light. While the non-selection signal is supplied to the scan line 42, the first transistor 31 is in the OFF-state and the third transistor 33 is in the ON-state. Upon this, the light emitting element 20 can emit light.

The light emitting element 20 and the fourth transistor 34 of the second inverter 62 are disposed in series between the third transistor 33 and the first potential line (low potential line 46). The fourth N-type transistor 34 is disposed on the low potential side with respect to the light emitting element 20. As described above, the fourth transistor 34 functions as a driving transistor for the light emitting element 20. In other words, while the fourth transistor 34 is in the ON-state, the light emitting element 20 may emit light.

When the non-selection signal is supplied to the scan line 42, the third transistor 33 is turned into the ON-state. In this state, if the potential of the input terminal 28 of the second inverter 62 is High and the fourth transistor 34 is in the ON-state, electric current flows from the second potential line (high potential line 47) to the first potential line (low potential line 46) through the third transistor 33, the light emitting element 20 and the fourth transistor 34. In this way, a current flows through the light emitting element 20 to cause the light emitting element 20 to emit light.

The third P-type transistor 33 is disposed on the high potential side with respect to the light emitting element 20, and the fourth N-type transistor 34 is disposed on the low potential side with respect to the light emitting element 20. More specifically, the source potential of the third transistor 33 is fixed at the second potential (V2) and the source potential of the fourth transistor 34 is fixed at the first potential (V1) to allow substantially linear operation of the third transistor 33 and the fourth transistor 34 when the light emitting element 20 emits light. Accordingly, any variation in the threshold voltage of the third transistor 33 and the fourth transistor 34 is prevented from affecting light emission intensity of the light emitting element 20.

A method for controlling the first transistor 31, the second transistor 32, and the third transistor 33 in the pixel circuit 41 according to Example 1 to cause writing or rewriting of an image signal to the memory circuit 60 and cause emission and non-emission of the light emitting element 20 will now be described.

In Example 1, the first transistor 31 and the second transistor 32 operate in a complementary manner to each other in response to the same scan signal, and the first transistor 31 and the third transistor 33 operate in a complementary manner to each other in response to the same scan signal. As a result, when the first transistor 31 is in the ON-state, the second transistor 32 and the third transistor 33 is always in the OFF-state.

When the image signal in the memory circuit 60 is written or rewritten, the first transistor 31 is turned into the ON-state by the selection signal to introduce the image signal to the memory circuit 60, i.e. the first inverter 61 and the second inverter 62. The image signal is written from the data line 43 to the first inverter 61, and then from the first inverter 61 to the second inverter 62.

While the first transistor 31 is in the ON-state, the second transistor 32 is in the OFF-state, so that the output terminal 27 of the second inverter 62 is electrically disconnected from the input terminal 25 of the first inverter 61. While the first transistor 31 is in the ON-state, the third transistor 33 is in the OFF-state. Accordingly, the path leading from the second potential line (high potential line 47) to the first potential line (low potential line 46) through the third transistor 33, the light emitting element 20, and the fourth transistor 34 is interrupted.

To understand present invention clearly, we consider an imaginary circuit, in which the second transistor 32 does not exist and therefore the output terminal 27 of the second inverter 62 is always connected to the input terminal 25 of the first inverter 61. When the input terminal 25 of the first inverter 61 in the imaginary circuit is rewritten from Low (VSS) to High (VDD), before a High signal is introduced to the input terminal 25 of the first inverter 61, its potential was Low, the potential of the input terminal 28 of the second inverter 62 was High, and the fourth transistor 34 is in the ON-state. Thus, when the first transistor 31 in the imaginary circuit turns into the ON-state and the High signal (VDD) is introduced from the data line 43, electric current flows from the data line 43, to which VDD is supplied at the current situation, to the low potential line 46 (VSS) through the first transistor 31 and the fourth transistor 34. This may cause an operational failure that it takes undesirably long time to rewrite the potential of the input terminal 25 from Low to High or that the potential is not rewritten.

We also consider another malfunction of the imaginary circuit, in which the second transistor 32 is not provided. When the input terminal 25 of the first inverter 61 in the imaginary circuit is rewritten from High (VDD) to Low (VSS), before the Low signal is introduced to the input terminal 25 of the first inverter 61, the potential of the input terminal 28 of the second inverter 62 was Low and the fifth transistor 35 was in the ON-state. Then, when the first transistor 31 turns into the ON-state and the Low signal (VSS) is introduced from the data line 43, electric current flows from the high potential line 47 (VDD) to the data line 43, to which VSS is supplied at the current situation, through the fifth transistor 35 and the first transistor 31. This causes the same failure described above.

The above-described operational failure is prevented in Example 1. When an image signal is written or rewritten to the memory circuit 60 with the first transistor 31 being in the ON-state, the second transistor 32 disposed between the input terminal 25 of the first inverter 61 and the output terminal 27 of the second inverter 62 is in the OFF-state, resulting in the electrical disconnection between the input terminal 25 and the output terminal 27. Thus the above-described operational failure is prevented in Example 1. In this way, the image signal is written or rewritten to the memory circuit 60 in a quick and reliable manner.

The third transistor 33 is in the OFF-state while the first transistor 31 is in the ON-state. Thus, the electric path between the second potential line (high potential line 47) and the first potential line (low potential line 46) is disconnected while an image signal is being written to the memory circuit 60. In this way, unnecessary current does not flow through the memory circuit 60, and thus the image signal is written or rewritten to the memory circuit 60 at low power consumption. In addition, the light emitting element 20 does not emit light while an image signal is being written, and thus a gray-scale is accurately displayed.

To understand present invention clearly, we consider another imaginary circuit, in which the complementary data line and a complementary transistor for the first transistor 31 are added. In this imaginary circuit, while an image signal is written to the first inverter 61 from the data line 43, a complementary image signal (complementary signal) of the image signal supplied to the data line 43 is written to the second inverter 62 from the complementary data line. By contrast, in the pixel circuit 41 in Example 1, when an image signal is written (or rewritten) to the memory circuit 60, the image signal is written from the data line 43 to the first inverter 61 and then a reverse signal (complementary signal) of the image signal is written from the first inverter 61 to the second inverter 62. This eliminates the need for a complementary data line and a complementary transistor for the first transistor 31 presented in the imaginary circuit. Accordingly, a higher resolution display that possesses finer pixels 59 is easily achieved and the manufacturing yield is improved in Example 1 compared to the imaginary circuit. This is because neither a complementary data line nor a complementary transistor is required in the pixel circuit 41 in Example 1.

After that, when the light emitting element 20 is caused to emit light, the second transistor 32 and the third transistor 33 are turned into the ON-state by the non-selection signal. Upon this, if the fourth transistor 34 is in the ON-state due to the image signal stored in the memory circuit 60, a current flows from the second potential line (high potential line 47) to the first potential line (low potential line 46) through the third transistor 33, the light emitting element 20 and the fourth transistor 34 to cause the light emitting element 20 to emit light.

While the light emitting element 20 emits light, the first transistor 31 is in the OFF-state and the second transistor 32 is in the ON-state such that the image signal stored in the memory circuit 60 is maintained and is not rewritten. In this way, a high-quality image is correctly displayed. As a result, gray-scales by time division are accurately displayed by controlling the ratio of emission to non-emission of the light emitting element 20, such that the electro-optical device 10 capable of displaying a high-resolution, multi-gray-scale, and high-quality image at a low power consumption is achieved at a low cost.

Potential of Each Signal

Next, a potential of each signal in the pixel circuit 41 according to Example 1 will be described. In Example 1, the drive circuit 51 and the memory circuit 60 are operated by a power supply supplied with a first potential (V1=VSS=2.0 V as one example) and a second potential (V2=VDD=7.0 V as one example). The image signal supplied from the data line 43 to the memory circuit 60 is either the first potential (V1) or the second potential (V2).

For the scan signal that consists of selection signal and non-selection signal, since the first transistor 31 is the N-type and the second transistor 32 and the third transistor 33 are the P-type, the selection signal for turning the first transistor 31 into the ON-state and the second transistor 32 and the third transistor 33 into the OFF-state is a high potential. The non-selection signal for turning the first transistor 31 into the OFF-state and the second transistor 32 and the third transistor 33 into the ON-state is a low potential. The potential of the selection signal is designated as a fourth potential (V4), and the potential of the non-selection signal is designated as a third potential (V3).

Since High of the image signal is the second potential (V2), the fourth potential (V4) of the selection signal is set to be higher than or equal to the second potential (V2). The fourth potential (V4) of the selection signal is preferably the second potential (V2) (that is, V4=V2=7.0 V). This ensures that the first transistor 31 is reliably turned into the ON-state and the second transistor 32 and the third transistor 33 into the OFF-state by the selection signal by the selection signal.

The third potential (V3) of the non-selection signal is set to $V3<V1+V_{th2}$ and is preferably V3=0 V as one example, where the threshold voltage of the second transistor 32 is $V_{th2}$ ($V_{th2}$=−0.36 V as one example). Since the second transistor 32 is the P-type, when $V3<V1+V_{th2}$, an absolute value of the gate-source voltage of the second transistor 32 becomes greater than an absolute value of the threshold voltage $V_{th2}$ of the second transistor 32 and the second transistor 32 is turned into the ON-state.

Then, if the third potential (V3) is lower than the first potential (V1), e.g. V3=0 V, the gate-source voltage of the second transistor 32 becomes sufficiently greater than the absolute value of the threshold voltage $V_{th2}$ of the second transistor 32, such that the second transistor 32 is turned into the strong ON-state, which has high electrical conductivity, by the non-selection signal, while the first transistor 31 is in the OFF-state.

Since the third transistor 33 is also the P-type, the threshold voltage $V_{th3}$ of the third transistor 33 is substantially identical to the threshold voltage $V_{th2}$ of the second transistor 32. The third transistor 33 will be reliably in the ON-state by the non-selection signal, if the third potential (V3) of the non-selection signal is set to $V3<V1+V_{th2}$. For example, if V3=0 V, an absolute value of the gate-source voltage of the third transistor 33 will be sufficiently greater than an absolute value of the threshold voltage $V_{th3}$ of the third transistor 33. Thus, the third transistor 33 is in the strong ON-state reliably and the resistance of the third transistor 33 in the ON-state (ON-resistance) is very low by the non-selection signal of V3=0 V.

Therefore, by introducing the third potential (V3=0 V as one example), in addition to the first potential (V1=2.0 V as one example) and the second potential (V2=7.0 V as one example) that are supplied to the memory circuit 60, the second transistor 32 and the third transistor 33 are reliably turned in the ON-state and the third transistor 33 is linearly operated in the ON-state while operating the drive circuit 51 and the memory circuit 60 at a high speed.

Characteristics of Transistor

Next, characteristics of transistors provided in the pixel circuit 41 according to Example 1 will be described. In the pixel circuit 41 according to Example 1, the ON-resistance of the third transistor 33 disposed in series with the light emitting element 20 is preferably sufficiently lower than the ON-resistance of the light emitting element 20. The term "sufficiently low" refers to a drive condition in which the third transistor 33 operates linearly and specifically, to a condition where the ON-resistance of the third transistor 33 is less than or equal to 1/100, preferably, less than or equal to 1/1000 of the ON-resistance of the light emitting element 20. This condition ensures that the third transistor 33 is linearly operated when the light emitting element 20 emits light.

The ON-resistance of the fourth transistor 34 is preferably less than or equal to the ON-resistance of the third transistor 33. When the ON-resistance of the fourth transistor 34 is less than or equal to the ON-resistance of the third transistor 33, the ON-resistance of the third transistor 33 is sufficiently lower than the ON-resistance of the light emitting element 20. Accordingly, the ON-resistance of the fourth transistor 34 is also sufficiently lower than the ON-resistance of the light emitting element 20.

When the ON-resistance of the third transistor 33 and the ON-resistance of the fourth transistor 34 are sufficiently lower than the ON-resistance of the light emitting element 20 as described above, both the third transistor 33 and the fourth transistor 34 can be linearly operated when a current flows through the light emitting element 20 to cause it to emit light. In this way, most of the potential drop, namely, the potential difference between the first potential and the second potential as the power supply voltage across the third transistor 33, the light emitting element 20, and the fourth transistor 34 that are disposed in series in the path leading from the second potential line (the high potential line 47) to the first potential line (the low potential line 46) applies to the light emitting element 20.

As a result, the influence of variation in the threshold voltage of the third transistor 33 or the fourth transistor 34 during emission of the light emitting element 20 is decreased. In other words, with such a configuration, the influence of variation in the threshold voltage of the third transistor 33 or the fourth transistor 34 can be reduced. As a result, the variation in brightness and the shift in gray-scale between the pixels 59, namely, the sub-pixels 58, can be suppressed and an image display having excellent uniformity can be achieved.

For example, when the ON-resistance of the third transistor 33 is 1/100 of the ON-resistance of the light emitting element 20, the ON-resistance of the fourth transistor 34 is also lower than or equal to 1/100 of the ON-resistance of the light emitting element 20. In this case, approximately 99% or more of the power supply voltage applies to the light emitting element 20, such that the potential drop across the third transistor 33 and the fourth transistor 34 will be less than or equal to approximately 1%. Accordingly, the influence that the variation in the threshold voltage of both of the transistors 33 and 34 have on the emission characteristics of the light emitting element 20 is significantly reduced. In this way, an image display can be achieved that has a decreased variation in brightness and a decreased shift in gray-scale between the pixels 59 including the sub-pixels 58 each placed into the selection state.

Furthermore, the ON-resistance of the fourth transistor 34 is preferably less than or equal to half of the ON-resistance of the third transistor 33. In this case, the ON-resistance of the fourth transistor 34 is lower than or equal to 1/200 of the ON-resistance of the light emitting element 20.

Further, when the ON-resistance of the third transistor 33 is 1/1000 of the ON-resistance of the light emitting element 20, the ON-resistance of the fourth transistor 34 is also lower than or equal to 1/1000 of the ON-resistance of the light emitting element 20. When the ON-resistance of the fourth transistor 34 is less than or equal to half of the ON-resistance of the third transistor 33, the ON-resistance of the fourth transistor 34 is lower than or equal to 1/2000 of the ON-resistance of the light emitting element 20. As a result, the series resistance of both of these transistors 33 and 34 is lower than or equal to approximately 1/1000 of the ON-resistance of the light emitting element 20.

In this case, since greater than or equal to approximately 99.9% of the power supply voltage applies to the light emitting element 20 such that the potential drop across both the transistors 33 and 34 is less than or equal to approximately 0.1%, the influence that the variation in the threshold voltage of both the transistors 33 and 34 have on the emission characteristics of the light emitting element 20 is almost negligible. As a result, a high-quality image display can be achieved in which the variation in brightness and the shift in gray-scale among the pixels 59 are decreased.

The ON-resistance of a transistor depends on the polarity, gate length, gate width, threshold voltage, gate-source voltage, gate insulating film thickness, and the like of the transistor. In Example 1, the polarity, gate length, gate width, threshold voltage, gate-source voltage, gate insulating film thickness, and the like of the transistor are determined to satisfy the above-described conditions. This is described below.

In Example 1, the organic EL element is used in the light emitting element 20, and the transistors such as the third transistor 33 and the fourth transistor 34 are formed on the element substrate 11 formed of a single-crystal silicon wafer. The current-voltage characteristics of the light emitting element 20 are represented approximately by Equation (2) below:

[Equation 2]

$$I_{EL} = L_{EL} W_{EL} J_0 \left\{ \exp\left( \frac{V_{EL} - V_0}{V_{tm}} \right) - 1 \right\} \tag{2}$$

In Equation 2, $I_{EL}$ is a current flowing through the light emitting element 20, $V_{EL}$ is a voltage applied to the light emitting element 20, $L_{EL}$ is the length of the light emitting element 20, $W_{EL}$ is the width of the light emitting element 20, $J_0$ is the current density coefficient of the light emitting element 20, $V_{tm}$ is the coefficient voltage of the light emitting element 20 having a temperature dependency (a constant voltage under a constant temperature), and $V_0$ is a threshold voltage for emission of light of the light emitting element 20.

Given that the power supply voltage is represented as $V_P$ and the potential drop across the third transistor 33 and the fourth transistor 34 is represented as $V_{ds}$, the following relation holds: $V_{EL}+V_{ds}=V_P$. In Example 1, $L_{EL}$=11 micrometers (μm), $W_{EL}$=3 micrometers (μm), $J_0$=1.449 milliamperes per square centimeters (mA/cm$^2$), $V_0$=2.0 volts (V), and $V_{tm}$=0.541 volt (V).

Provided that the power supply voltage $V_P$ is V2−V1=5.0 V and the third transistor 33 and the fourth transistor 34 operate linearly, the current-voltage characteristics of the light emitting element 20 can be approximated by Equation 3 below using $V_{ds}$, at $V_{ds}$=approximately 0 V:

[Equation 3]

$$I_{EL} = -kV_{ds} + I_0 \tag{3}$$

For Example 1, the coefficient k defined by Equation 3 is such that: k=2.27×10$^{-7}$ (Ω$^{-1}$). $I_0$ is the amount of current when all power supply voltage $V_P$ is applied to the light emitting element 20, and $I_0$=1.222×10$^{-7}$ (A).

On the other hand, the drain current $I_{dsi}$ of an i-th transistor (where i is 3 or 4) such as the third transistor 33 and the fourth transistor 34 is expressed by Equation 4 below:

[Equation 4]

$$I_{dsi} = \frac{W_i}{L_i} \cdot \frac{\varepsilon_0 \varepsilon_{ox}}{t_{oxi}} \cdot \mu_i (V_{gsi} - V_{thi}) V_{dsi} \equiv Z_i (V_{gsi} - V_{thi}) V_{dsi} \tag{4}$$

In Equation 4, $W_i$ is the gate width of the i-th transistor, $L_i$ is the gate length of the i-th transistor, $\varepsilon_0$ is the permittivity of vacuum, $\varepsilon_{ox}$ is the permittivity of a gate insulating film, $t_{oxi}$ is the thickness of the gate insulating film, $\mu_i$ is the mobility of an i-th transistor, $V_{gsi}$ is the gate voltage, $V_{dsi}$ is the drain voltage and the potential drop by the i-th transistor, and $V_{thi}$ is the threshold voltage of the i-th transistor.

In Example 1, $W_3$=0.5 micrometers (μm), $L_3$=0.5 micrometers (μm), $W_4$=1.0 micrometers (μm), $L_4$=0.5 micrometers (μm), $t_{ox3}=t_{ox4}$=20 nanometers (nm), $\mu_3$=150 square centimeters per volt per second (cm$^2$/V·s), $\mu_4$=240 square centimeters per volt per second (cm$^2$/V·s), $V_{th3}$=−0.36 V, $V_{th4}$=0.36 V, $V_{gs3}$=V3−V2=0 V−7.0 V=−7.0 V, and $V_{gs4}$ V2−V1=7.0 V−2.0 V=5.0 V.

In this way, the gate width $W_4$ of the fourth transistor 34 may be set to be greater than the gate width $W_3$ of the third transistor 33. This is preferred as it makes it easy to achieve the ON-resistance of the fourth transistor 34 that is less than or equal to the ON-resistance of the third transistor 33. Further, the fourth transistor 34 may be set to be the N-type and the third transistor 33 may be set to be the P-type. This is preferred as it makes it easy to achieve the ON-resistance of the fourth transistor 34 that is less than or equal to the ON-resistance of the third transistor 33.

Under such a condition, a voltage of light emitted by the light emitting element 20 is a voltage such that $I_{EL}=I_{ds}$ in Equations 2 and 4. In Example 1, $V_P$=V2−V1=5.0 V, $V_{ds3}$=−0.0007 V, $V_{ds4}$=0.0003 V, $V_{EL}$=4.9990 V, $I_{EL}=I_{ds3}=I_{ds4}$=1.219×10$^{-7}$ A. Upon this, the ON-resistance of the third transistor 33 was 5.818×10$^3$Ω, the ON-resistance of the fourth transistor 34 was 2.602×10$^3$Ω, and the ON-resistance of the light emitting element 20 was 4.100×10$^7$Ω.

Therefore, the ON-resistance of the fourth transistor 34 was approximately 1/16000 of the ON-resistance of the light emitting element 20, which is lower than 1/1000, and the ON-resistance of the third transistor 33 was approximately 1/7000 of the ON-resistance of the light emitting element 20, which is also lower than 1/1000. Thus, most of the power supply voltage can be applied to the light emitting element 20. Under this condition, even when the threshold voltage of a transistor varies by 80% or greater, values of $V_{EL}$, $I_{EL}$, $I_{ds1}$, and $I_{ds4}$ are invariable. For example, if $V_{th3}$ and $V_{th4}$ vary between 0.27 V and 0.86 V in the above-described example, $V_{EL}$=4.999 V and $I_{EL}=I_{ds1}=I_{ds4}$=1.22×10$^{-7}$ A are invariable.

In general, the threshold voltage of the transistor does not vary significantly in such a manner. Accordingly, by reducing the ON-resistance of the third transistor 33 to lower than or equal to approximately 1/1000 of the ON-resistance of the light emitting element 20, the influence that the variation in the threshold voltage of the third transistor 33 and the fourth transistor 34 have on the amount of emission of the light emitting element 20 can be substantially eliminated.

By simultaneously solving Equation (3) and Equation (4) with $I_{EL}=I_{dsi}$, the influence of variation in the threshold voltage of the third transistor 33 and the fourth transistor 34 on $I_{EL}=I_{dsi}$ can be approximated by Equation 5 below:

[Equation 5]

$$\left(1 + \frac{k}{Z_i (V_{gsi} - V_{thi})}\right) I_{EL} = I_0 \tag{5}$$

Since $I_0$ is the amount of current when all the power supply voltage $V_P$ applies to the light emitting element 20, $V_{gsi}$ and $Z_i$ may be increased to cause the light emitting element 20 to emit light around the power supply voltage as seen from Equation 5. In other words, the emission intensity becomes less likely to be affected by the variation in the threshold voltage of the transistors as $Z_i$ increases.

Since $k/Z_4$=2.74×10$^{-3}$ V and $k/Z_3$=8.76×10$^{-3}$ V are small values in Example 1, the second term on the left side of Equation 5 is $k/(Z_4\ (V_{gs4}-V_{th4}))$=0.0006 for the fourth transistor 34 and $k/(Z_4\ (V_{gs4}-V_{th4}))$=0.0013 for the third transistor 33, and is thus less than approximately 0.01 (1%). As a result, the current (emission intensity) during the emission of the light emitting element 20 was little affected by the threshold voltages of the transistors.

In other words, the variation in the threshold voltage of the transistors affecting the emission intensity of the light emitting element 20 can be eliminated by setting a value of $k/(Z_i(V_{gsi}-V_{thi}))$ to be less than approximately 0.01 (1%). Note that, the definition of k and $Z_i$ is according to Equations 3 and 4. As a greater $V_{gsi}$ is preferred, it is assumed in Example 1 that the third potential (V3=0 V) lower than the second potential (V2) is set for the non-selection signal as the scan signal in the non-selection state.

In Example 1, the ON-resistance of the fourth transistor 34 is less than or equal to the ON-resistance of the third transistor 33. As described above, the ON-resistance of the fourth transistor 34 is preferably less than or equal to half of the ON-resistance of the third transistor 33. Therefore, in order to reduce the ON-resistance of the fourth transistor 34 to lower than or equal to half of the ON-resistance of the third transistor 33, the polarity, gate length, and gate width of the fourth transistor 34 and the third transistor 33, and the drive condition, such as a potential of the non-selection signal, are determined.

When the ON-resistance of the fourth transistor 34 is less than or equal to the ON-resistance of the third transistor 33, the electrical conductance of the fourth transistor 34 is increased to greater than the current driving capacity of the third transistor 33. Then, when the ON-resistance of the fourth transistor 34 is less than or equal to half of the ON-resistance of the third transistor 33, the electrical conductance of the fourth transistor 34 can be increased to twice or higher than the current driving capacity of the third transistor 33. As a result, the possibility that the image signal stored in the memory circuit 60 may be rewritten during the emission of the light emitting element 20 can be reduced. This is described below.

A state is considered where the third transistor 33 is switched from the OFF-state to the ON-state to cause emission of the light emitting element 20 while the potential of the output terminal 27 of the second inverter 62 of the memory circuit 60 is Low. Upon this, in a case where the ON-resistance of the fourth transistor 34 is greater than the ON-resistance of the third transistor 33 and the ON-resistance of the light emitting element 20 is relatively small, then a drain potential of the fourth transistor 34, namely, the potential of the output terminal 27, may increase and exceed a logical inversion potential of the second inverter 62.

On the other hand, the ON-resistance of the fourth transistor 34 is less than or equal to the ON-resistance of the third transistor 33 in Example 1. Thus, even when the ON-resistance of the light emitting element 20 is assumed to be zero, a logical inversion potential of an inverter is usually almost equal to half of a power supply potential. Accordingly, the potential of the output terminal 27 is not increased up to a half of a power supply potential, and does not increase and exceed a logical inversion potential of the second inverter 62. Therefore, the possibility that an image signal stored in the memory circuit 60 is rewritten during emission of the light emitting element 20 may be substantially eliminated by setting the ON-resistance of the fourth transistor 34 to be less than or equal to the ON-resistance of the third transistor 33 as in Example 1.

Note that, the gate length $L_1$ of the first transistor 31 is preferably substantially identical to the gate length of a transistor in the memory circuit 60, and is preferably substantially identical to the gate length of the fourth transistor 34, for example. The reason is that the maximum value of the source-drain voltage of the first transistor 31 is the amplitude (V2−V1) of an image signal and is the same as the source-drain voltage of the transistor in the memory circuit 60. Further, the gate width $W_1$ of the first transistor 31 is preferably greater than the gate width of a transistor in the memory circuit 60, and is preferably greater than the gate width of the fourth transistor 34, for example. This is to allow an image signal to pass through the first transistor 31 at a high speed. In Example 1, $W_1$=1 micrometer (μm) and $L_1$=0.5 micrometers (μm).

Method for Driving Pixel Circuit

Figure 9:
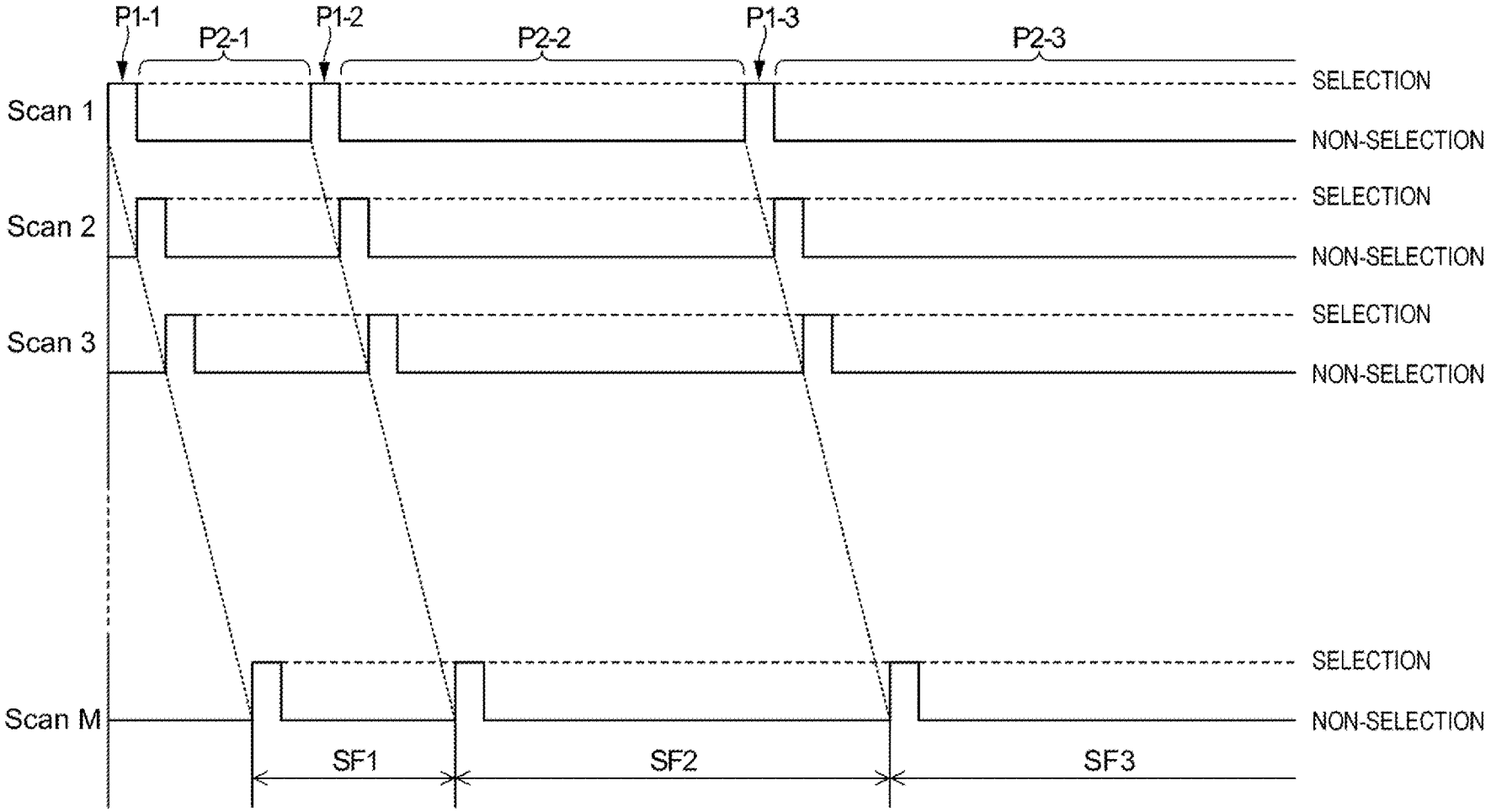
FIG. 9 is a diagram illustrating a method for driving a pixel circuit according to the present exemplary embodiment.

Next, a method for driving a pixel circuit in the electro-optical device 10 according to the present exemplary embodiment will be described with reference to FIG. 9. FIG. 9 is a diagram illustrating a method for driving a pixel circuit according to the present exemplary embodiment. In FIG. 9, the horizontal axis is a time axis. In the vertical axis in FIG. 9, Scan 1 to Scan M represent scan signals supplied to the respective scan lines 42 from the first row to the M-th row of the M scan lines 42 (see FIG. 5). The scan signal includes a selection signal as a scan signal in a selection state and a non-selection signal as a scan signal in a non-selection state.

As described with reference to FIG. 7, one field (F) during which a single image is displayed is divided into a plurality of subfields (SFs), and each subfield of SF1 to SF6 includes a first period P1 as a non-display period and a second period P2 as a display period starting after the first period ends. The first period P1 as the non-display period is a signal writing period. The second period P2 as the display period is a period during which the light emitting element 20 (see FIG. 8) is allowed to emit light.

As illustrated in FIG. 9, scan signals of Scan 1 to Scan M are successively supplied to from a first scan line 42 to an M-th scan line 42 in the electro-optical device 10 according to the present exemplary embodiment. Each scan signal of Scan 1 to Scan M is introduced to each of the subfields SF1 to SF6. The selection signal is supplied as each of the scan signals to the first period P1, that is, the non-display period of each of the subfields (SFs). The non-selection signal is supplied as each of the scan signals to the second period P2, that is, the display period.

When the selection signal is supplied to the first period P1 in each of the subfields (SFs), the first transistor 31 (see FIG. 8) is placed into the ON-state and the second transistor 32 and the third transistor 33 (see FIG. 8) are placed into the OFF-state in the selected pixel circuit 41. In this way, an image signal is written to the memory circuit 60 from the data line 43 (see FIG. 8) in the selected pixel circuit 41.

After the image signal is written to the memory circuit 60, the first transistor 31 is placed into the OFF-state and the second transistor 32 and the third transistor 33 are placed into the ON-state in the pixel circuit 41 shifted from the selection to the non-selection in the second period P2. In this way, an image signal written to the memory circuit 60 in the subfield (SF) is maintained in the non-selected pixel circuit 41 to allow emission of the light emitting element 20.

As described above, the configuration of the pixel circuit 41 according to Example 1 can achieve an electro-optical device 10 that can display a high-resolution, multi-gray-scale, and high-quality image at low power consumption while operating at a higher speed and achieving a brighter display.

Hereinafter, modification examples (modification examples 1 to 6) of the pixel circuit of Example 1 will be described with reference to FIG. 8. In the following description of the modification examples, only differences between Example 1 or the above-described modification example and the modification examples below will be described.

Modification Example 1

While the cathode 23 of the light emitting element 20 in Example 1 is electrically connected to the output terminal 27 of the second inverter 62, the cathode 23 of the light emitting element 20 may be electrically connected to the output terminal 26 of the first inverter 61, namely, the input terminal 28 of the second inverter 62. In such a configuration, the sixth transistor 36 also functions as a driving transistor for the light emitting element 20. In other words, when the sixth transistor 36 is placed into the ON-state while the third transistor 33 is in the ON-state, electrical communication is established through the path leading from the second potential line (high potential line 47), through the third transistor 33, the light emitting element 20, and the sixth transistor 36, to the first potential line (low potential line 46) to cause emission of the light emitting element 20.

Modification Example 2

While the first transistor 31 is the N-type and the second transistor 32 and the third transistor 33 are the P-type in Example 1, the first transistor 31 may be the P-type, and the second transistor 32 and the third transistor 33 may be the N-type. In other words, the first transistor 31 may be a first P-type transistor 31A in Example 3 described later, and the second transistor 32 and the third transistor 33 may be respectively a second N-type transistor 32A and a third N-type transistor 33A. In this case, the first potential (V1) is a high potential (V1=VDD=5.0 V as one example), and the second potential (V2) is a low potential (V2=VSS=0 V as one example).

Since the first transistor 31A is the P-type, the fourth potential (V4) as the potential of the selection signal is a low potential set to be lower than or equal to the second potential (V2) and is preferably the second potential (V2) (that is, V4=V2=0 V). In this way, the absolute value of a gate-source voltage of the first transistor 31A is sufficiently greater than the absolute value of the threshold voltage $V_{th1}$ ($V_{th1}$=−0.36 V as one example) of the first transistor 31A, such that the first transistor 31A can be placed into the ON-state reliably by the selection signal.

On the other hand, since the second transistor 32A is the N-type, the third potential (V3) as the potential of the non-selection signal is set to $V3>V1+V_{th2}$ and is preferably such that V3=7.0 V, assuming that the threshold voltage of the second transistor 32A is $V_{th2}$ ($V_{th2}$=0.36 V as one example). When $V3>V1+V_{th2}$, the second transistor 32A is reliably in the ON-state even if the input terminal 25 of the first inverter 61 and the output terminal 27 of the second inverter 62 are High, that is, even if they are the first potential in the present modification example. For example, when V3=7.0 V, the second transistor 32A can be in the ON-state reliably by the non-selection signal even if the input terminal 25 of the first inverter 61 and the output terminal 27 of the second inverter 62 are set to V1=5.0 V. In this way, the image signal written to the memory circuit 60 can be maintained in a stable state.

Further, the third transistor 33A is also the N-type, such that setting the third potential (V3) to the above-described condition can reduce the ON-resistance of the third transistor 33A by the non-selection signal and significantly reduce the potential drop by the third transistor 33A. Therefore, the second transistor 32 and the third transistor 33 are preferably the same conductive type, that is, both are preferably the N-type or the P-type.

Modification Example 3

In the configuration of Example 1, the scan line 42 may be designated as a first scan line and a second scan line separate from the scan line 42 may be provided to electrically connect to the gate of the second transistor 32. In such a configuration, a selection signal and a non-selection signal are individually supplied as scan signals to the first transistor 31 and the second transistor 32, and thus the first transistor 31 and the second transistor 32 may be the same conductive type, that is, both may be the N-type or the P-type.

Modification Example 4

In the configuration of Modification Example 3 in which the second scan line is provided, the gate of the third transistor 33 may be electrically connected to the gate of the second scan line. In such a configuration, a selection signal and a non-selection signal are individually supplied as scan signals to the first transistor 31 and the third transistor 33, and thus the first transistor 31 and the third transistor 33 may be the same conductive type, that is, both may be the N-type or the P-type.

Modification Example 5

In the configuration of Example 1, the fourth potential (V4) of the selection signal as the high potential may be such that $V4>V2+V_{th1}$, whereas the third potential (V3) of the non-selection signal as the low potential may be such that $V3<V1+V_{th2}$. As one example, when the first potential (V1) as the low potential is V1=1.0 V and the second potential (V2) as the high potential is V2=6.0 V, the third potential (V3) may be V3=0 V and the fourth potential (V4) may be V4=7.0 V.

As described above, by introducing the third potential (V3) and the fourth potential (V4) as potentials of the selection signal and the non-selection signal, that is, the scan signals, in addition to the first potential (V1) and the second potential (V2) for operating the memory circuit 60, the absolute values of the gate-source voltage of the first transistor 31 in the selection state and the gate-source voltage of the second transistor 32 in the non-selection state can be further increased. In this way, the first transistor 31 can be placed into the ON-state reliably by the selection signal, and the second transistor 32 can be placed into the ON-state reliably by the non-selection signal. In this case, the third transistor 33 can be placed into the ON-state reliably by the non-selection signal, and the ON-resistance of the third transistor 33 in the ON-state can also be reduced.

Modification Example 6

In the configuration of Modification Example 2, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the third potential (V3) may be V3=7.0 V and the fourth potential (V4) may be V4=0 V. Also, in such a setting, the first transistor 31A can be placed into the ON-state reliably by the selection signal, and the second transistor 32A and the third transistor 33A can be placed into the ON-state reliably by the non-selection signal.

Example 2

Configuration of Pixel Circuit

Figure 10:
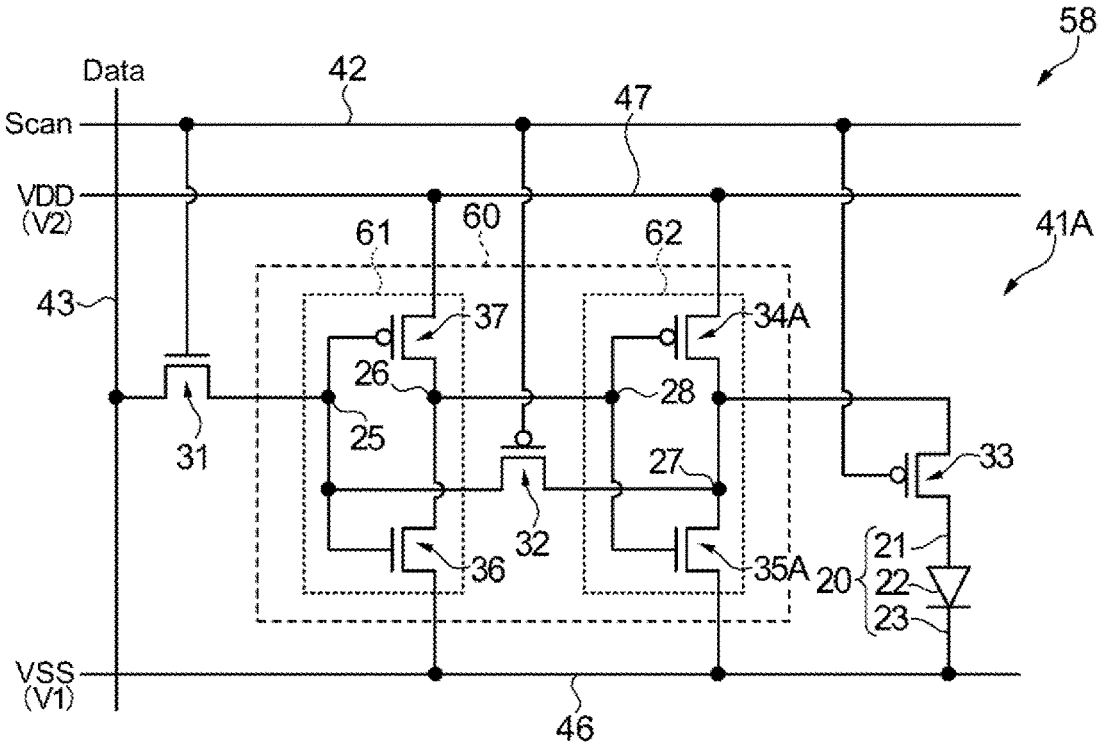
FIG. 10 is a diagram illustrating a configuration of a pixel circuit according to Example 2.

Next, a configuration of a pixel circuit according to Example 2 will be described. FIG. 10 is a diagram illustrating a configuration of the pixel circuit according to Example 2. In the following description of Example 2, only differences between Example 1 and Example 2 will be described. Throughout the drawings, like numerals are assigned to the same components as those in Example 1 and their description will be omitted.

As illustrated in FIG. 10, a pixel circuit 41A according to Example 2 includes the light emitting element 20, a first N-type transistor 31, the memory circuit 60, and a third P-type transistor 33. A second P-type transistor 32 is disposed between the output terminal 27 of the second inverter 62 and the input terminal 25 of the first inverter 61 in the memory circuit 60. The pixel circuit 41A according to Example 2 is different from the pixel circuit 41 according to Example 1 in that the light emitting element 20 and the third transistor 33 are disposed in series between the output terminal 27 of the second inverter 62 in the memory circuit 60 and the first potential line (low potential line 46) and that a fourth transistor 34A of the second inverter 62 is the P-type and a fifth transistor 35A is the N-type.

The source of the third transistor 33 is electrically connected to the output terminal 27 of the second inverter 62. Furthermore, the output terminal 27 is electrically connected to drains of the fourth transistor 34A and the fifth transistor 35A. The drain of the third transistor 33 is electrically connected to the anode 21 of the light emitting element 20. In the pixel circuit 41A according to Example 2, the anode 21 corresponds to a first terminal of the light emitting element 20. The cathode 23 of the light emitting element 20 is electrically connected to the first potential line (low potential line 46). In other words, the third P-type transistor 33 is disposed on the high potential side with respect to the light emitting element 20 and the fourth P-type transistor 34A is disposed on the high potential side with respect to the third transistor 33.

In the pixel circuit 41A according to Example 2, the light emitting element 20 may be placed into an emission state when the potential of the input terminal 28 of the second inverter 62 to which the output terminal 26 of the first inverter 61 is electrically connected is Low, that is, when the potential of the output terminal 27 of the second inverter 62 is High. The light emitting element 20 is placed into a non-emission state when the potential of the input terminal 28 of the second inverter 62 to which the output terminal 26 of the first inverter 61 is electrically connected is High, that is, when the potential of the output terminal 27 of the second inverter 62 is Low.

The fourth transistor 34A functions as a driving transistor for the light emitting element 20 in the pixel circuit 41A according to Example 2. When the fourth transistor 34A is placed into the ON-state while the third transistor 33 is in the ON-state, electrical communication is established through the path leading from the second potential line (high potential line 47), through the fourth transistor 34A, the third transistor 33, and the light emitting element 20, to the first potential line (low potential line 46) to cause emission of the light emitting element 20.

In the pixel circuit 41A according to Example 2, the fourth transistor 34A of the second inverter 62 is disposed between the third transistor 33 and the second potential line (high potential line 47). Thus, when the fourth transistor 34A and the third transistor 33 are placed into the ON-state, the source potential of the third transistor 33 becomes slightly lower than the second potential (V2). However, with the source potential of the fourth transistor 34A fixed at the second potential (V2) to allow linear operation of the fourth transistor 34A, the source potential of the third transistor 33 can be substantially equal to the second potential (V2) to allow linear operation of the third transistor 33.

The potential of each signal in the pixel circuit 41A according to Example 2 can be set to be identical to the potential of each signal in the pixel circuit 41 according to Example 1. The configuration of the pixel circuit 41A according to Example 2 can also achieve an electro-optical device 10 that can display a high-resolution, multi-gray-scale, and high-quality image at low power consumption while operating at a higher speed and achieving a brighter display.

Hereinafter, modification examples (Modification Examples 7 to 12) of the pixel circuit of Example 2 will be described with reference to FIG. 10. In the following description of the modification examples, only differences between Example 2 or the above-described modification examples and the modification examples below will be described.

Modification Example 7

While the source of the third transistor 33 is electrically connected to the output terminal 27 of the second inverter 62 in Example 2, the source of the third transistor 33 may be electrically connected to the input terminal 28 of the second inverter 62, that is, the output terminal 26 of the first inverter 61. In such a configuration, the seventh transistor 37 also functions as a driving transistor for the light emitting element 20. In other words, when the seventh transistor 37 is placed into the ON-state while the third transistor 33 is in the ON-state, electrical communication is established through the path leading from the second potential line (high potential line 47), through the seventh transistor 37, the third transistor 33, and the light emitting element 20, to the first potential line (low potential line 46) to cause emission of the light emitting element 20.

Modification Example 8

While the first transistor 31 is the N-type and the second transistor 32 and the third transistor 33 are the P-type in Example 2, the first transistor 31, the second transistor 32, and the third transistor 33 may be respectively the first P-type transistor 31A, the second N-type transistor 32A, and the third N-type transistor 33A similarly to those in the configuration of Example 3. In this case, the first potential (V1) is a high potential (V1=VDD=5.0 V as one example), and the second potential (V2) is a low potential (V2=VSS=0 V as one example).

Since the first transistor 31A is the P-type, the fourth potential (V4) as the potential of the selection signal is a low potential set to be lower than or equal to the second potential (V2) and is preferably the second potential (V2) (that is, V4=V2=0 V). In this way, the absolute value of a gate-source voltage of the first transistor 31A is sufficiently greater than the absolute value of the threshold voltage $V_{th1}$ ($V_{th1}$=−0.36 V as one example) of the first transistor 31A, such that the first transistor 31A can be placed into the ON-state reliably by the selection signal.

On the other hand, since the second transistor 32A is the N-type, the third potential (V3) as the potential of the non-selection signal is set to $V3>V1+V_{th2}$ and is preferably such that V3=7.0 V, assuming that the threshold voltage of the second transistor 32A is $V_{th2}$ ($V_{th2}$=0.36 V as one example). When V3>V1+$V_{th2}$, the second transistor 32A is reliably in the ON-state even if the input terminal 25 of the first inverter 61 and the output terminal 27 of the second inverter 62 are High, that is, even if they are the first potential in the present modification example. For example, when V3=7.0 V, the second transistor 32A can be in the ON-state reliably by the non-selection signal even if the input terminal 25 of the first inverter 61 and the output terminal 27 of the second inverter 62 are set to V1=5.0 V. In this way, the image signal written to the memory circuit 60 can be maintained in a stable state.

Further, the third transistor 33A is also the N-type, such that setting the third potential (V3) to the above-described condition can reduce the ON-resistance of the third transistor 33A by the non-selection signal and significantly reduce the potential drop by the third transistor 33A. Therefore, the second transistor 32 and the third transistor 33 are preferably the same conductive type, that is, both are preferably the N-type or the P-type.

Modification Example 9

In the configuration of Example 2, the scan line 42 may be designated as a first scan line and a second scan line separate from the scan line 42 may be provided to electrically connect to the gate of the second transistor 32. In such a configuration, a selection signal and a non-selection signal are individually supplied as scan signals to the first transistor 31 and the second transistor 32, and thus the first transistor 31 and the second transistor 32 may be the same conductive type, that is, both may be the N-type or the P-type.

Modification Example 10

In the configuration of Modification Example 9 in which the second scan line is provided, the gate of the third transistor 33 may be electrically connected to the gate of the second scan line. In such a configuration, a selection signal and a non-selection signal are individually supplied as scan signals to the first transistor 31 and the third transistor 33, and thus the first transistor 31 and the third transistor 33 may be the same conductive type. That is, both may be the N-type or the P-type.

Modification Example 11

In the configuration of Example 2, the fourth potential (V4) of the selection signal as the high potential may be such that V4>V2+$V_{th1}$ and the third potential (V3) of the non-selection signal as the low potential may be such that V3<V1+$V_{th2}$. As one example, when the first potential (V1) as the low potential is V1=1.0 V and the second potential (V2) as the high potential is V2=6.0 V, the third potential (V3) may be V3=0 V and the fourth potential (V4) may be V4=7.0 V.

As described above, by introducing the third potential (V3) and the fourth potential (V4) as potentials of the selection signal and the non-selection signal as the scan signals in addition to the first potential (V1) and the second potential (V2) for operating the memory circuit 60, the absolute values of the gate-source voltage of the first transistor 31 in the selection state and the gate-source voltage of the second transistor 32 in the non-selection state can be further increased. In this way, the first transistor 31 can be placed into the ON-state reliably by the selection signal, and the second transistor 32 can be placed into the ON-state reliably by the non-selection signal. In this case, the third transistor 33 can be placed into the ON-state reliably by the non-selection signal, and the ON-resistance of the third transistor 33 in the ON-state can also be reduced.

Modification Example 12

In the configuration of Modification Example 8, the fourth potential (V4) of the selection signal as the low potential may be such that V4<V2+$V_{th1}$, and the third potential (V3) of the non-selection signal as the high potential may be such that V3>V1+$V_{th2}$. As one example, when the first potential (V1) as the high potential is V1=6.0 V and the second potential (V2) as the low potential is V2=1.0 V, the third potential (V3) may be V3=7.0 V and the fourth potential (V4) may be V4=0 V. Also, in such a setting, the first transistor 31A can be placed into the ON-state reliably by the selection signal, and the second transistor 32A and the third transistor 33A can be placed into the ON-state reliably by the non-selection signal.

Example 3

Configuration of Pixel Circuit

Figure 11:
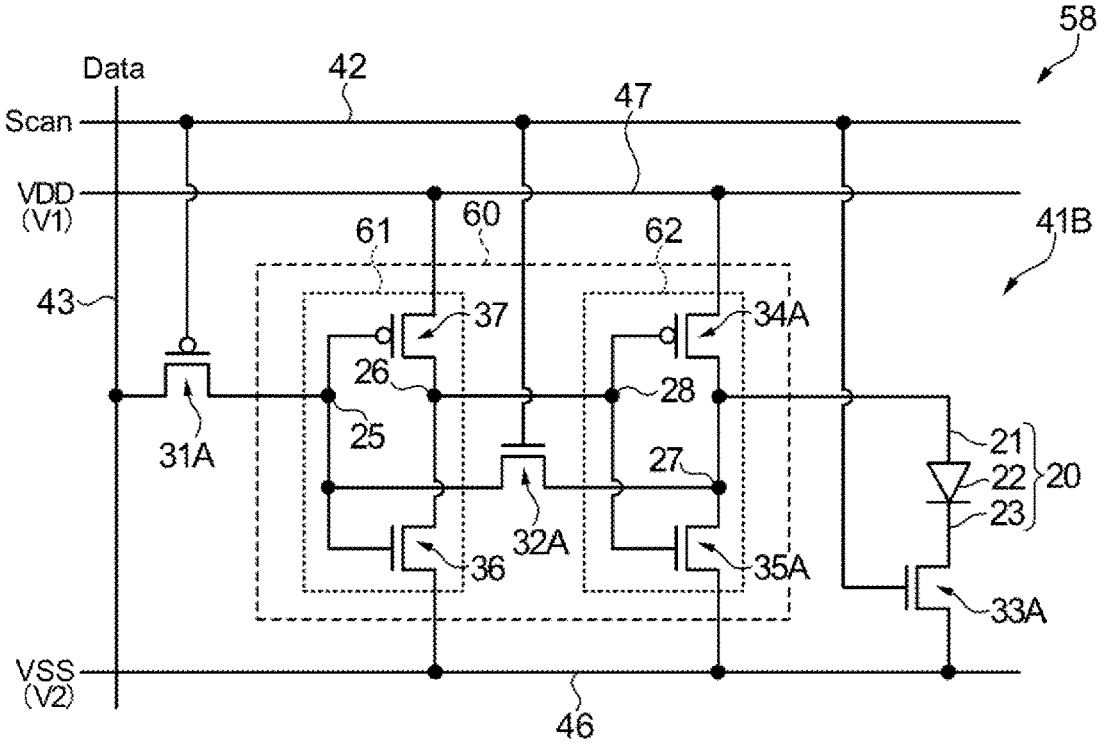
FIG. 11 is a diagram illustrating a configuration of a pixel circuit according to Example 3.

Next, a configuration of a pixel circuit according to Example 3 will be described. FIG. 11 is a diagram illustrating a configuration of the pixel circuit according to Example 3. In the following description of Example 3, only differences between the above-described examples and Example 3 will be described. Throughout the drawings, like numerals are assigned to the same components as those in the above-described examples and their description will be omitted.

As illustrated in FIG. 11, a pixel circuit 41B according to Example 3 includes the light emitting element 20, the first P-type transistor 31A, the memory circuit 60, and the third N-type transistor 33A. A second N-type transistor 32A is disposed between the output terminal 27 of the second inverter 62 and the input terminal 25 of the first inverter 61 in the memory circuit 60. In other words, the pixel circuit 41B according to Example 3 is different from the pixel circuit 41A according to Example 2 in that the first transistor 31A is the P-type instead of the N-type, the second transistor 32A is the N-type instead of the P-type, and the third transistor 33A is the N-type instead of the P-type.

A high potential and a low potential in the pixel circuit 41A according to Example 2 are switched in the pixel circuit 41B according to Example 3. Specifically, the first potential (V1) is a high potential VDD (V1=VDD=5.0 V as one example), and the second potential (V2) is a low potential VSS (V2=VSS=0 V as one example). The first potential (V1) is supplied from the high potential line 47 as a first potential line. The second potential (V2) is supplied from the low potential line 46 as a second potential line.

The source of the sixth transistor 36 is electrically connected to the second potential line (low potential line 46), and the source of the seventh transistor 37 is electrically connected to the first potential line (high potential line 47) in the first inverter 61 constituting the memory circuit 60. The source of the fifth transistor 35A is electrically connected to the second potential line (low potential line 46), and the source of the fourth transistor 34A is electrically connected to the first potential line (high potential line 47) in the second inverter 62.

The first transistor 31A is disposed between the input terminal 25 of the first inverter 61 of the memory circuit 60 and the data line 43. The second transistor 32A is disposed between the output terminal 27 of the second inverter 62 and an input terminal 25 of the first inverter 61 in the memory circuit 60. The first P-type transistor 31A and the second N-type transistor 32A are different conductive types from each other and operate in a complementary manner to each other.

The third transistor 33A is disposed in series with the light emitting element 20 between the output terminal 27 of the second inverter 62 electrically connected to drains of the fourth transistor 34A and the fifth transistor 35A and the second potential line (low potential line 46). The anode 21 of the light emitting element 20 is electrically connected to the output terminal 27 of the second inverter 62. The cathode 23 of the light emitting element 20 is electrically connected to the drain of the third transistor 33A. In the pixel circuit 41B according to Example 3, the anode 21 corresponds to a first terminal of the light emitting element 20. The source of the third transistor 33A is electrically connected to the second potential line (low potential line 46). In other words, the third N-type transistor 33A is disposed on the low potential side with respect to the light emitting element 20, and the fourth P-type transistor 34A is disposed on the high potential side with respect to the light emitting element 20.

The fourth transistor 34A functions as a driving transistor for the light emitting element 20 also in the pixel circuit 41B according to Example 3. When the fourth transistor 34A is placed into the ON-state while the third transistor 33A is in the ON-state, electrical communication is established through the path leading from the first potential line (high potential line 47), through the fourth transistor 34A, the light emitting element 20, and the third transistor 33A, to the second potential line (low potential line 46) to cause emission of the light emitting element 20.

With the source potential of the third transistor 33A fixed at the second potential (V2), the third transistor 33A can be linearly operated in the pixel circuit 41B according to Example 3. With the source potential of the fourth transistor 34A fixed at the first potential (V1), the fourth transistor 34A can be linearly operated. Accordingly, any variation in the threshold voltage of the third transistor 33A and the fourth transistor 34A can be prevented from affecting display characteristics.

Potential of Each Signal

Next, a potential of each signal in the pixel circuit 41B according to Example 3 will be described. In Example 3, the drive circuit 51 and the memory circuit 60 are operated by a power supply supplied with a first potential (V1=VDD=5.0 V as one example) and a second potential (V2=VSS=0 V as one example). The image signal supplied from the data line 43 to the memory circuit 60 is either the first potential (V1) or the second potential (V2).

For a selection signal and a non-selection signal as the scan signals, since the first transistor 31A is the P-type and the second transistor 32A and the third transistor 33A are the N-type, the selection signal for placing the first transistor 31A into the ON-state and the second transistor 32A and the third transistor 33A into the OFF-state is a low potential. Further, the non-selection signal for placing the first transistor 31A into the OFF-state and the second transistor 32A and the third transistor 33A into the ON-state is a high potential. The potential of the selection signal is designated as a fourth potential (V4), and the potential of the non-selection signal is designated as a third potential (V3).

The fourth potential (V4) of the selection signal may be set to be lower than or equal to the second potential (V2) and is preferably the second potential (V2) (that is, V4=V2=0 V). In this way, the first transistor 31A can be placed into the ON-state and the second transistor 32A and the third transistor 33A into the OFF-state reliably by the selection signal, such that an image signal can be written or rewritten to the memory circuit 60 in a quick and reliable manner.

The third potential (V3) of the non-selection signal is set to $V3>V1+V_{th2}$ and is preferably V3=7.0 V as one example, assuming that the threshold voltage of the second transistor 32A is $V_{th2}$ ($V_{th2}$=0.36 V as one example). Since the second transistor 32A is the N-type, when $V3>V1+V_{th2}$, the gate-source voltage of the second transistor 32A becomes greater than the threshold voltage $V_{th2}$ of the second transistor 32A and the second transistor 32A is placed into the ON-state.

Then, when the third potential (V3) is higher than the first potential (V1) with V3=7.0 V, the gate-source voltage of the second transistor 32A becomes sufficiently greater than the threshold voltage $V_{th2}$ of the second transistor 32A, such that the second transistor 32A can be placed into the ON-state having high electrical conductivity by the non-selection signal and the first transistor 31A can be placed into the OFF-state. In this way, the image signal stored in the memory circuit 60 can be maintained in a stable state.

Since the third transistor 33A is also the N-type, the threshold voltage $V_{th3}$ of the third transistor 33A is substantially identical to the threshold voltage $V_{th2}$ of the second transistor 32A. The third transistor 33A can be placed into the ON-state reliably by the non-selection signal by setting the third potential (V3) of the non-selection signal to $V3>V1+V_{th2}$.

Then, when V3=0 V, the gate-source voltage of the third transistor 33A can be sufficiently greater than the threshold voltage $V_{th3}$ of the third transistor 33A. Thus, the third transistor 33A can be placed into the ON-state reliably by the non-selection signal and the ON-resistance of the third transistor 33A in the ON-state can also be reduced. Therefore, with the configuration of the pixel circuit 41B according to Example 3, an electro-optic device 10 that can display a high-quality image without any display error can also be achieved.

Hereinafter, modification examples (Modification Examples 13 to 18) of the pixel circuit of Example 3 will be described with reference to FIG. 11. In the following description of the modification examples, only differences between Example 3 or the above-described modification examples and the modification examples below will be described.

Modification Example 13

While the anode 21 of the light emitting element 20 is electrically connected to the output terminal 27 of the second inverter 62 in Example 3, the anode 21 of the light emitting element 20 may be electrically connected to the input terminal 28 of the second inverter 62, that is, the output terminal 26 of the first inverter 61. In such a configuration, the seventh transistor 37 also functions as a driving transistor for the light emitting element 20.

Modification Example 14

While the first transistor 31A is the P-type and the second transistor 32A and the third transistor 33A are the N-type in Example 3, the first transistor 31A, the second transistor 32A, and the third transistor 33A may be respectively the first N-type transistor 31, the second P-type transistor 32, and the third P-type transistor 33 similarly to those in the configuration of Example 1. In this case, the first potential (V1) is a low potential (V1=VSS=2.0 V as one example), and the second potential (V2) is a high potential (V2=VDD=7.0 V as one example).

Since the first transistor 31 is the N-type, the fourth potential (V4) as the potential of the selection signal is a high potential set to be greater than or equal to the second potential (V2) and is preferably the second potential (V2) (that is, V4=V2=7.0 V). In this way, the first transistor 31 can be placed into the ON-state reliably by the selection signal.

On the other hand, since the second transistor 32 is the P-type, the third potential (V3) as the potential of the non-selection signal is set to $V3<V1+V_{th2}$ and is preferably such that V3=0 V, assuming that the threshold voltage of the second transistor 32 is $V_{th2}$ ($V_{th2}$=−0.36 V as one example). When $V3<V1+V_{th2}$, the second transistor 32 is reliably in the ON-state even if the input terminal 25 of the first inverter 61 and the output terminal 27 of the second inverter 62 are Low, that is, even if they are the first potential in the present modification example. For example, when V3=0 V, the second transistor 32 can be in the ON-state reliably by the non-selection signal even if the input terminal 25 of the first inverter 61 and the output terminal 27 of the second inverter 62 are set to V1=2.0 V.

Further, the third transistor 33 is also the P-type, such that setting the third potential (V3) to the above-described condition can reduce the ON-resistance of the third transistor 33 by the non-selection signal and significantly reduce the potential drop by the third transistor 33.

Modification Example 15

In the configuration of Example 3, the scan line 42 may be designated as a first scan line and a second scan line separate from the scan line 42 may be provided to electrically connect to the gate of the second transistor 32A. In such a configuration, a selection signal and a non-selection signal are individually supplied as scan signals to the first transistor 31A and the second transistor 32A, and thus the first transistor 31A and the second transistor 32A may be the same conductive type, that is, both may be the N-type or the P-type.

Modification Example 16

In the configuration of Modification Example 15 in which the second scan line is provided, the gate of the third transistor 33A may be electrically connected to the gate of the second scan line. In such a configuration, a selection signal and a non-selection signal are individually supplied as scan signals to the first transistor 31A and the third transistor 33A, and thus the first transistor 31A and the third transistor 33A may be the same conductive type, that is, both may be the N-type or the P-type.

Modification Example 17

In the configuration of Example 3, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the third potential (V3) may be V3=7.0 V and the fourth potential (V4) may be V4=0 V. As described above, by introducing the third potential (V3) and the fourth potential (V4) as potentials of the selection signal and the non-selection signal, that is, the scan signals, in addition to the first potential (V1) and the second potential (V2) operating the memory circuit 60, the first transistor 31A can be placed into the ON-state reliably by the selection signal and the second transistor 32A and the third transistor 33A can be placed into the ON-state reliably by the non-selection signal.

Modification Example 18

In the configuration of Modification Example 14, the fourth potential (V4) of the selection signal as the high potential may be such that $V4>V2+V_{th1}$ and the third potential (V3) of the non-selection signal as a low potential may be such that $V3<V1+V_{th2}$. As one example, when the first potential (V1) as the low potential is V1=1.0 V and the second potential (V2) as the high potential is V2=6.0 V, the fourth potential (V4) may be V4=7.0 V and the third potential (V3) may be V3=0 V. Also, in such a setting, the first transistor 31 can be placed into the ON-state reliably by the selection signal, and the second transistor 32 and the third transistor 33 can be placed into the ON-state reliably by the non-selection signal.

Example 4

Configuration of Pixel Circuit

Figure 12:
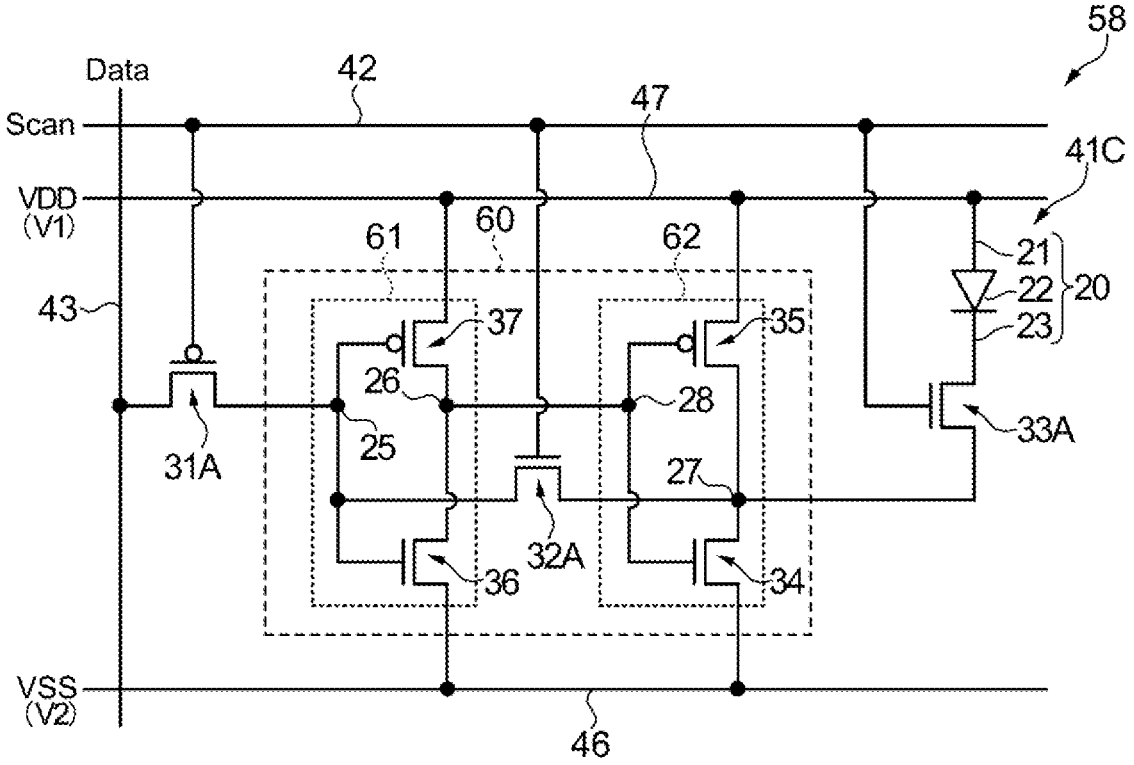
FIG. 12 is a diagram illustrating a configuration of a pixel circuit according to Example 4.

Next, a configuration of a pixel circuit according to Example 4 will be described. FIG. 12 is a diagram illustrating a configuration of the pixel circuit according to Example 4. In the following description of Example 4, only differences between the above-described examples and Example 4 will be described. Throughout the drawings, like numerals are assigned to the same components as those in the above-described examples and their description will be omitted.

As illustrated in FIG. 12, a pixel circuit 41C according to Example 4 includes the light emitting element 20, the first P-type transistor 31A, the memory circuit 60, and the third N-type transistor 33A. A second N-type transistor 32A is disposed between the output terminal 27 of the second inverter 62 and the input terminal 25 of the first inverter 61 in the memory circuit 60.

The pixel circuit 41C according to Example 4 is different from the pixel circuit 41B according to Example 3 in that the light emitting element 20 and the third transistor 33A are disposed in series between the first potential line (high potential line 47) and the output terminal 27 of the second inverter 62 in the memory circuit 60.

The anode 21 of the light emitting element 20 is electrically connected to the first potential line (high potential line 47). The cathode 23 of the light emitting element 20 is electrically connected to the drain of the third transistor 33A. In the pixel circuit 41C according to Example 4, the cathode 23 corresponds to a first terminal of the light emitting element 20. The source of the third transistor 33A is electrically connected to the output terminal 27 of the second inverter 62. In other words, the third N-type transistor 33A is disposed on the low potential side with respect to the light emitting element 20 and the fourth N-type transistor 34 is disposed on the low potential side with respect to the third transistor 33A.

In the pixel circuit 41C according to Example 4, the light emitting element 20 is placed into a state that allows emission when the potential of the output terminal 26 of the first inverter 61 electrically connected to the input terminal 28 of the second inverter 62 is High, that is, when the potential of the output terminal 27 of the second inverter 62 is Low. The light emitting element 20 is placed into a non-emission state when the potential of the output terminal 26 of the first inverter 61 is Low, that is, when the potential of the output terminal 27 of the second inverter 62 is High.

The fourth transistor 34 functions as a driving transistor for the light emitting element 20 in the pixel circuit 41C according to Example 4. When the fourth transistor 34 is placed into the ON-state while the third transistor 33A is in the ON-state, electrical communication is established through the path leading from the first potential line (high potential line 47), through the light emitting element 20, the third transistor 33A, and the fourth transistor 34, to the second potential line (low potential line 46) to cause emission of the light emitting element 20.

The fourth transistor 34 of the second inverter 62 is disposed between the third transistor 33A and the second potential line (low potential line 46). Thus, when the fourth transistor 34 and the third transistor 33A are placed into the ON-state, the source potential of the third transistor 33A becomes slightly higher than the second potential (V2). However, with the source potential of the fourth transistor 34 fixed at the second potential (V2) to allow linear operation of the fourth transistor 34, the source potential of the third transistor 33A can be substantially equal to the second potential (V2) to allow linear operation of the third transistor 33A. Accordingly, any variation in the threshold voltage of the third transistor 33A and the fourth transistor 34 can be prevented from affecting display characteristics.

The potential of each signal in the pixel circuit 41C according to Example 4 can be set to be identical to the potential of each signal in the pixel circuit 41B according to Example 3. The configuration of the pixel circuit 41C according to Example 4 can also achieve an electro-optical device 10 that can display a high-resolution, multi-gray-scale, and high-quality image at low power consumption while operating at a higher speed and achieving a brighter display.

Hereinafter, modification examples (Modification Examples 19 to 25) of the pixel circuit of Example 4 will be described with reference to FIG. 12. In the following description of the modification examples, only differences between Example 4 or the above-described modification examples and the modification examples below will be described.

Modification Example 19

While the source of the third transistor 33A is electrically connected to the output terminal 27 of the second inverter 62 in Example 4, the source of the third transistor 33A may be electrically connected to the output terminal 26 of the first inverter 61, that is, the input terminal 28 of the second inverter 62. In such a configuration, the sixth transistor 36 also functions as a driving transistor for the light emitting element 20.

Modification Example 20

While the first transistor 31A is the P-type and the second transistor 32A and the third transistor 33A are the N-type in Example 4, the first transistor 31A, the second transistor 32A, and the third transistor 33A may be respectively the first N-type transistor 31, the second P-type transistor 32, and the third P-type transistor 33 similarly to those in Example 1.

Modification Example 21

In the configuration of Example 4, the scan line 42 may be designated as a first scan line and a second scan line separate from the scan line 42 may be provided to electrically connect to the gate of the second transistor 32. In such a configuration, a selection signal and a non-selection signal are individually supplied as scan signals to the first transistor 31A and the second transistor 32A, and thus the first transistor 31A and the second transistor 32A may be the same conductive type, that is, both may be the N-type or the P-type.

Modification Example 22

In the configuration of Modification Example 21 in which the second scan line is provided, the gate of the third transistor 33 may be electrically connected to the gate of the second scan line. In such a configuration, a selection signal and a non-selection signal are individually supplied as scan signals to the first transistor 31A and the third transistor 33A, and thus the first transistor 31A and the third transistor 33A may be the same conductive type, that is, both may be the N-type or the P-type.

Modification Example 23

In the configuration of Example 4, the fourth potential (V4) of the selection signal as the low potential may be such that $V4<V2+V_{th1}$, and the third potential (V3) of the non-selection signal as the high potential may be such that $V3>V1+V_{th2}$. As one example, when the first potential (V1) as the high potential is V1=6.0 V and the second potential (V2) as the low potential is V2=1.0 V, the third potential (V3) may be V3=7.0 V and the fourth potential (V4) may be V4=0 V. As described above, by introducing the third potential (V3) and the fourth potential (V4) as potentials of the selection signal and the non-selection signal, that is, the scan signals, in addition to the first potential (V1) and the second potential (V2) operating the memory circuit 60, the first transistor 31A can be placed into the ON-state reliably by the selection signal and the second transistor 32A can be placed into the ON-state reliably by the non-selection signal.

Modification Example 24

In the configuration of Modification Example 20, the fourth potential (V4) of the selection signal as the high potential may be such that $V4>V2+V_{th1}$ and the third potential (V3) of the non-selection signal as a low potential may be such that $V3<V1+V_{th2}$. As one example, when the first potential (V1) as the low potential is V1=1.0 V and the second potential (V2) as the high potential is V2=6.0 V, the third potential (V3) may be V3=0 V and the fourth potential (V4) may be V4=7.0 V. Also, in such a setting, the first transistor 31 can be placed into the ON-state reliably by the selection signal, and the second transistor 32 can be placed into the ON-state reliably by the non-selection signal.

The above-described exemplary embodiments (examples and modification examples) merely illustrate one aspect of the invention, and modification and application may further be possible within the scope of the invention. Hereinafter, modification examples other than the above-described modification examples will be described.

Modification Example 25

While the memory circuit 60 includes the two inverters 61 and 62 in the configuration of each of Examples 1, 2, 3, and 4 and each of the modification examples, the memory circuit 60 may include two or more even-numbered inverters.

Modification Example 26

While in the exemplary embodiments described above, an organic EL device in which the light emitting elements 20 each including an organic EL element are arranged in 720 rows×3840 (1280×3) columns on an element substrate 11 formed of a single-crystal semiconductor substrate as a single-crystal silicon wafer is described as an exemplary electro-optic device, the electro-optic device of the invention is not limited to such an aspect. For example, the electro-optical device may include a thin film transistor (TFT) as each transistor formed on the element substrate 11 formed of a glass substrate, or the electro-optical device may include a TFT on a flexible substrate formed of polyimide and the like. Further, the electro-optical device may be a micro LED display in which fine LED elements are aligned as light emitting element light emitting elements in high density or a quantum dots display in which a nanosized semiconductor crystal material is used for the light emitting element. Furthermore, a quantum dot that converts incident light into light having a different wavelength may be used as a color filter.

Modification Example 27

While the electronic apparatus has been described in the above-described exemplary embodiments by taking, as an example, the see-through head-mounted display 100 incorporating the electro-optical device 10, the electro-optical device 10 of the invention is also applicable to other electronic apparatuses including a closed-type head-mounted display. Other types of electronic apparatus include, for example, projectors, rear-projection televisions, direct-viewing televisions, cell phones, portable audio devices, personal computers, video camera monitors, automotive navigation devices, head-up displays, pagers, electronic organizers, calculators, wearable devices such as wristwatches, handheld displays, word processors, workstations, video phones, POS terminals, digital still cameras, signage displays, and the like.

The entire disclosure of Japanese Patent Application No. 2017-242457, filed Dec. 19, 2017 is expressly incorporated by reference herein.

What is claimed is:

1. An electro-optical device, comprising:

a scan line;

a data line;

a pixel circuit located at a position corresponding to an intersection of the scan line and the data line;

a first potential line supplying a first potential; and a second potential line supplying a second potential that differs from the first potential, wherein the pixel circuit includes a light emitting element, a first transistor, a memory circuit that includes a first inverter, a second inverter and a second transistor, and a third transistor, the memory circuit is disposed between the first potential line and the second potential line, the first transistor is disposed between an input of the first inverter and the data line, the second transistor is disposed between an output of the second inverter and the input of the first inverter, an output of the first inverter is electrically connected to an input of the second inverter, the third transistor and the light emitting element are disposed between the first potential line and the memory circuit, and when the first transistor is in an ON-state, the second transistor and the third transistor are in an OFF-state.

2. The electro-optical device according to claim 1, wherein the first transistor and the second transistor operate in a complementary manner to each other, and the first transistor and the third transistor operate in a complementary manner to each other.

3. The electro-optical device according to claim 2, wherein the first transistor is a first conductive type and the second transistor and the third transistor are a second conductive type different from the first conductive type, and a gate of the first transistor, a gate of the second transistor, and a gate of the third transistor are electrically connected to the scan line.

4. The electro-optical device according to claim 1, wherein a drain of the third transistor is electrically connected to the light emitting element.

5. The electro-optical device according to claim 1, wherein the second inverter includes a fourth transistor, and a source of the fourth transistor is electrically connected to the second potential line, and a drain of the fourth transistor is electrically connected to the light emitting element.

6. An electronic apparatus comprising the electro-optical device according to claim 1.

* * * * *